US011819090B2

(12) United States Patent
Chen et al.

(10) Patent No.: US 11,819,090 B2
(45) Date of Patent: Nov. 21, 2023

(54) BUFFING SYSTEM FOR FOOTWEAR

(71) Applicant: NIKE, Inc., Beaverton, OR (US)

(72) Inventors: Chun-Chieh Chen, Huatan Township (TW); Yi-Min Chen, Hemei Township (TW); Chia-Hung Lin, Changhua (TW); Hsien-Kuang Wu, Taichung (TW); Hung-Yu Wu, Huatan Township (TW)

(73) Assignee: NIKE, Inc., Beaverton, OR (US)

( * ) Notice: Subject to any disclaimer, the term of this patent is extended or adjusted under 35 U.S.C. 154(b) by 95 days.

(21) Appl. No.: 17/021,751

(22) Filed: Sep. 15, 2020

(65) Prior Publication Data

US 2021/0076780 A1 Mar. 18, 2021

Related U.S. Application Data

(60) Provisional application No. 62/900,983, filed on Sep. 16, 2019.

(51) Int. Cl.

| | |
|---|---|
| ***A43D 95/24*** | (2006.01) |
| ***A43D 63/00*** | (2006.01) |
| ***A46B 13/00*** | (2006.01) |
| ***A46B 13/02*** | (2006.01) |
| ***B24D 13/10*** | (2006.01) |

(52) U.S. Cl.

CPC ..... *A43D 95/24* (2013.01); *A43D 63/00* (2013.01); *A46B 13/001* (2013.01); *A46B 13/02* (2013.01); *B24D 13/10* (2013.01); *A46B 2200/40* (2013.01)

(58) Field of Classification Search

CPC ..... A43D 95/24; A43D 63/00; A43D 37/00; A46B 13/001; A46B 2200/40; A46B 13/02; B24D 13/10

See application file for complete search history.

(56) References Cited

U.S. PATENT DOCUMENTS

| | | | |
|---|---|---|---|
| 1,092,469 | A | 4/1914 | Beaudry |
| 3,233,438 | A | 2/1966 | Tore et al. |

(Continued)

FOREIGN PATENT DOCUMENTS

| | | | |
|---|---|---|---|
| CN | 2229232 | Y | 6/1996 |
| CN | 1819895 | A | 8/2006 |

(Continued)

OTHER PUBLICATIONS

International Search Report and Written Opinion received for PCT Patent Application No. PCT/US2020/051017, dated Nov. 17, 2020, 13 pages.

(Continued)

*Primary Examiner* — Sharon M Prange
*Assistant Examiner* — Erick I Lopez
(74) *Attorney, Agent, or Firm* — SHOOK, HARDY & BACON L.L.P.

(57) ABSTRACT

Buffing of a footwear component allows for an alteration of the component surface to achieve an intended surface for aesthetics and/or manufacturing purposes. The buffing is performed in a system having a vision module, a sidewall buffing module, an up surface buffing module, and a down surface buffing module. Each of the buffing modules are adapted for the unique shape and sizes of a footwear component to effectively and automatically buff the footwear component.

21 Claims, 14 Drawing Sheets

(56) References Cited

U.S. PATENT DOCUMENTS

| | | | | | |
|---|---|---|---|---|---|
| 3,769,649 | A * | 11/1973 | Imhof | A43D 37/00 12/146 B |
| 3,961,390 | A * | 6/1976 | Giordano | A43D 95/08 12/1 A |
| 4,561,139 | A | 12/1985 | Becka et al. | |
| 4,691,398 | A | 9/1987 | Kadogawa et al. | |
| 5,481,467 | A * | 1/1996 | Smith | A43D 37/00 700/186 |
| 2014/0081441 | A1 | 3/2014 | Regan et al. | |
| 2015/0107030 | A1 * | 4/2015 | Regan | B29C 44/5627 12/38 |
| 2016/0345800 | A1 | 12/2016 | Macintyre et al. | |
| 2018/0325219 | A1 | 11/2018 | Jurkovic et al. | |

FOREIGN PATENT DOCUMENTS

| | | | | | |
|---|---|---|---|---|---|
| CN | 101664297 | A | | 3/2010 | |
| CN | 201431022 | Y | | 3/2010 | |
| CN | 102240197 | A | | 11/2011 | |
| CN | 106820462 | A | | 6/2017 | |
| CN | 107599374 | A | | 1/2018 | |
| CN | 206822131 | U | | 1/2018 | |
| CN | 107736697 | A | * | 2/2018 | |
| DE | 19749898 | A1 | | 5/1999 | |
| DE | 10343620 | A1 | * | 4/2005 | A43D 1/08 |
| EP | 0042672 | A1 | | 12/1981 | |
| GB | 1453735 | A | | 10/1976 | |
| GB | 1459635 | A | | 12/1976 | |
| JP | 57-29301 | | | 2/1982 | |
| JP | 2000194123 | A | | 7/2000 | |
| JP | 2002191543 | A | | 7/2002 | |
| JP | 2003-339616 | A | | 12/2003 | |
| JP | 2010214554 | A | | 9/2010 | |
| TW | 242249 | | | 3/1995 | |
| TW | 560308 | U | | 11/2003 | |
| TW | M528725 | U | | 9/2016 | |
| TW | 201900967 | A | | 1/2019 | |
| TW | 201900969 | A | | 1/2019 | |
| TW | I762608 | B | | 5/2022 | |

OTHER PUBLICATIONS

International Search Report and Written Opinion received for PCT Patent Application No. PCT/US2020/051020, dated Nov. 19, 2020, 11 pages.

International Preliminary Report on Patentability received for PCT Patent Application No. PCT/US2020/051016, dated Mar. 31, 2022, 9 pages.

International Preliminary Report on Patentability received for PCT Patent Application No. PCT/US2020/051017, dated Mar. 31, 2022, 8 pages.

International Preliminary Report on Patentability received for PCT Patent Application No. PCT/US2020/051020, dated Mar. 31, 2022, 8 pages.

International Preliminary Report on Patentability received for PCT Patent Application No. PCT/US2020/051023, dated Mar. 31, 2022, 8 pages.

International Search Report and Written Opinion received for PCT Patent Application No. PCT/US2020/051016, dated Jan. 29, 2021, 12 pages.

International Search Report and Written Opinion received for PCT Patent Application No. PCT/US2020/051023, dated Jan. 12, 2021, 11 pages.

Intention to Grant received for European Patent Application No. 20781253.8, dated Mar. 31, 2023, 7 pages.

Non-Final Office Action received for U.S. Appl. No. 17/021,748, dated Apr. 12, 2023, 14 pages.

Non-Final Office Action received for U.S. Appl. No. 17/021,748, dated Oct. 31, 2022, 15 pages.

Intention to Grant received for European Patent Application No. 20780886.6, dated Feb. 1, 2023, 7 pages.

Intention to Grant received for European Patent Application No. 20781683.6, dated Feb. 15, 2023, 7 pages.

Notice of Allowance received for U.S. Appl. No. 17/021,754, dated Aug. 18, 2022, 10pages.

Notice of Allowance Received for U.S. Appl. No. 17/021,744, dated Jul. 25, 2023, 9 pages.

* cited by examiner

BUFFING SYSTEM FOR FOOTWEAR

CROSS-REFERENCE TO RELATED APPLICATIONS

This application claims the benefit of priority of U.S. application Ser. No. 62/900,983, entitled "Buffing System For Footwear", and filed Sep. 16, 2019. The entirety of which is incorporated by reference herein.

TECHNICAL FIELD

Aspects hereof relate to a system and method for buffing an article of footwear component during manufacturing.

BACKGROUND

Buffing is a process that adjusts a surface of an article through mechanical engagement with the surface. Components forming at least a portion of an article of footwear, such as a shoe, are buffed to adjust a surface for appearances, future manufacturing processes (e.g., better adhesion of paint, dye, materials, adhesives), and/or refinement of sizing. Buffing has traditionally been a labor-intensive process

BRIEF SUMMARY

Aspects hereof provide a system for buffing a component forming an article of footwear. The system is comprised of a variety of discrete modules effective to buff different surfaces of the component. The component, in an exemplary aspect, is a sole portion for an article of footwear. The system includes a vision system effective to capture the component and to aid in determining operations, positions, and/or sizes useable by other modules of the system. The system also includes a sidewall buffing module effective to buff a sidewall of the component. The system includes an up surface buffing module effective to buff a surface of the component exposed upwardly in the system. For example, a sole component may be processed in the system such that what would be a ground-facing surface of the sole component when in an as-worn configuration is processed in the system is an up surface as the sole component passes through the system. The system also includes a down surface buffing module effective to buff a down surface of the component (i.e., opposite surface of the up surface). The system may also include one or more conveyance mechanisms effective to convey the component through the system. Further, it is contemplated that the system may have two (or more) lines each serving a portion of a mated pair of footwear component (e.g., a right sole on a first processing line of the system and a left sole on a second processing line of the system).

Aspects herein also contemplate a method of buffing an article of footwear component with a buffing system. The method includes buffing a sidewall of the component, such as a shoe sole portion, with a sidewall buffing module of the system. The method also include buffing an up surface of the component with a brush of an up surface buffing module. The brush of the up buffing module rotates in a first direction along a first portion of the up surface and the brush rotates in an opposite second direction along a second portion of the up surface. The method also includes conveying the component from the up surface buffing module to a down surface buffing module. The method includes buffing a down surface of the component at the down surface buffing module with a brush and a compression member.

This summary is provided to enlighten and not limit the scope of methods and systems provided hereafter in complete detail.

DESCRIPTION OF THE DRAWINGS

The present invention is described in detail herein with reference to the attached drawing figures, wherein.

DETAILED DESCRIPTION

Figure 1:
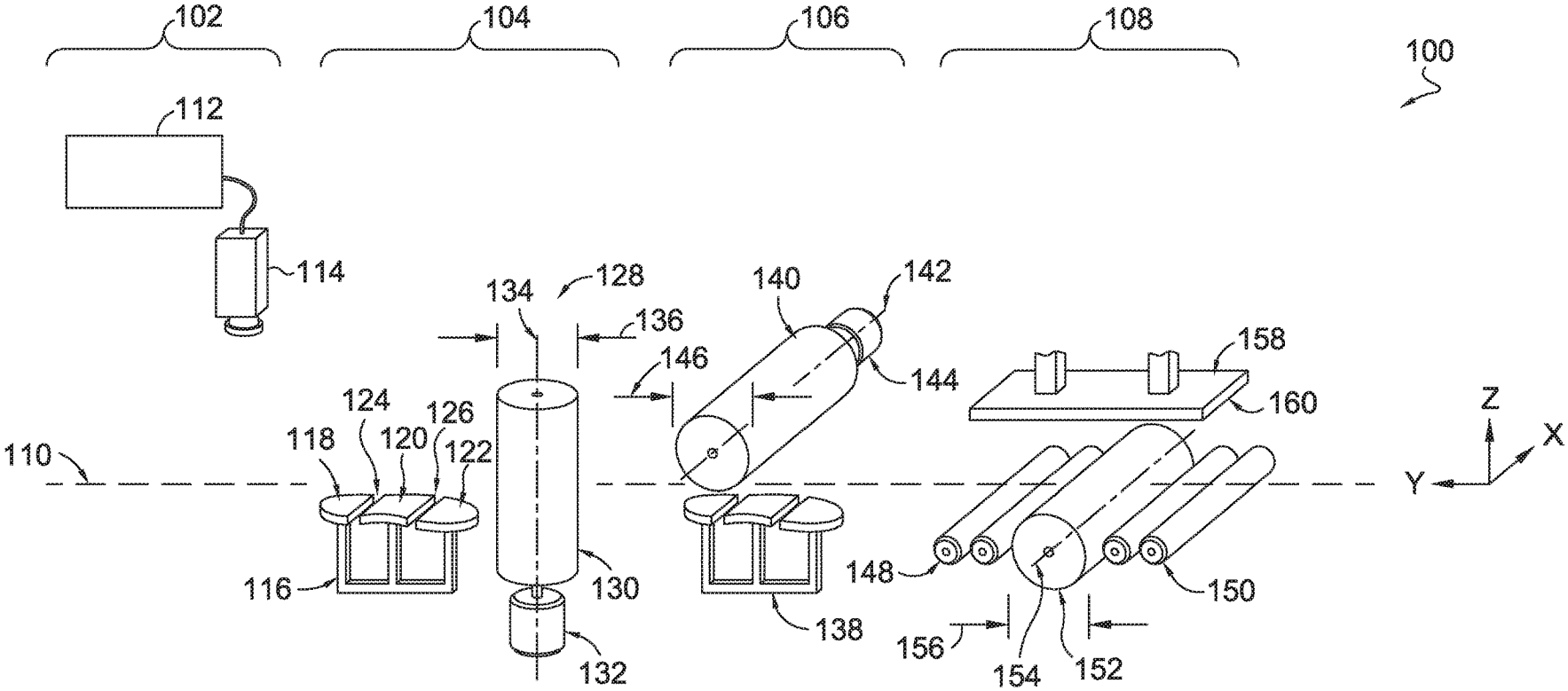
FIG. 1 depicts an example of a system for buffing a component of an article of footwear, in accordance with exemplary aspects hereof.

Aspects hereof provide apparatuses, systems and/or methods to buff a component of an article of footwear. Buffing is a mechanical process that alters a surface of an article. The alteration may be from a removal or polishing of a surface. Buffing may be performed on a footwear component to achieve an intended appearance or surface finish. Buffing may be performed on a footwear component to remove manufacturing residue, such as mold release, oil, surface contaminants, residual forming materials, and the like. For example, a sole of an article of footwear may be molded from foamed polymeric composition that is then buffed on one or more surfaces to achieve an appropriate surface. The polymeric composition may comprise ethylene-vinyl acetate ("EVA"), polyurethane ("PU"), silicone, and the like. The buffing operation may occur in anticipation of a subsequent manufacturing operation, such as painting, adhesive application, molding, and/or the like.

Buffing may be achieved through a physical contact of a buffing surface against the component to be buffed that causes an abrasion of material on the surface of the component to be buffed. The buffing surface may be a brush-like ("brush" hereinafter) element that contains a plurality of bristles that are positioned to interact with the component surface to be buffed. The brush element may be moved relative to the component surface to be buffed, the component surface to be buffed may be moved relative to the brush element, or a combination of the brush element and the component surface to be buffed may both move. The movement of the brush element includes the brush as a whole moving in an X, Y, and/or Z direction relative to the component surface to be buffed. The movement of the brush element also includes the brush moving in a rotational manner about an X, Y, and/or Z axis (e.g., a spinning or rotating brush). The movement of the brush element also includes a combination of the brush as a whole moving in an X, Y, and/or Z direction and the brush rotating about one or more of the X, Y, and/or Z axis.

Buffing may also be accomplished through additional mechanisms that are effective to alter a surface of a footwear component. For example, the buffing may be accomplished through a projection of a media (e.g., media blasting). The media may be any compositions, such as dry ice (solid form CO2), baking soda (sodium bicarbonate), salt (sodium chloride), sand, and the like. In these examples, the media is projected at the component surface with pressure, such as compressed air, to abrade the surface. However, in some examples, buffing with media results in residual media being captured in the component, additional costs associated with acquiring or cleaning the media, contamination of the environment through air-born distribution of the media, and the like. As such, some aspects contemplated herein rely on a mechanical interaction between a buffing surface (e.g., bristles on a brush) and the component in lieu of a media abrasion.

Because footwear components may have compound curves and complex shapes, a variety of buffing modules are contemplated that are each uniquely configured to address the shape of a footwear component, such as a sole. The system contemplates, in exemplary aspects, a first module that is configured to buff a sidewall surface of the component. For a footwear sole component, the sidewall forms a variety of concave (e.g., midfoot region) and convex (toe end and heel end) curves that provide challenges to consistently buffing in a non-automated manner. The system also contemplates an up surface buffing module that is configured to buff the up-facing surface of the component as the component passes through the system. As will be depicted herein, the up-facing surface of the component may be an intended ground-facing surface of the footwear when in an as-worn position. Because the component is supported in the up surface module from below, a series of clamps that are configured to secure the footwear component may clamp a first portion of the component while buffing a second portion of the component and the module may clamp the second portion of the component while buffing the first portion. As will be discussed, a direction of brush movement and/or rotation may be changed for the first portion and the second portion to achieve an intended buffing result. The system also contemplates, in exemplary aspects, a down surface buffing module that is configured to buff a down-facing surface of the component. A down-facing surface in the contemplated system may be a foot-facing surface of a sole component when in an as-worn orientation. The down-facing surface of a sole may have complex curves caused by sidewall portions extending toward the buffing apparatus from the down-facing surface. As such, to effective buff the down-facing surface of a sole component, the bristles extend past the length of the sidewall to effectively contact the down-facing surface (e.g., the foot-facing surface of a sole when in an as-worn configuration). This may be accomplished, as will be discussed, with a downward pressure from a top plate as well as a series of supporting rollers on either side of a brush having bristles that extend above a support plane defined by the series/plurality of support rollers. Additional configurations and combinations are contemplated in connection with the system.

Turning to the figures and FIG. 1 specifically that depicts an example of a system 100 for buffing a component of an article of footwear, in accordance with exemplary aspects hereof. The system 100 is comprised of a plurality of modules having different intended functions. A vision module 102, a sidewall buffing module 104, an up surface buffing module 106, and a down surface buffing module 108 are contemplated and depicted in FIG. 1. It is understood that any of the modules may be arranged in an alternative order or sequence. Additionally, it is contemplated that one or more modules may be omitted altogether. In an aspect, when the vision module 102 is included, it precedes one or more of the buffing modules in a component flow direction (Y axial direction of FIG. 1) as the vision module is effective to identify a component, a component position, a component, orientation, and/or a component size that may then control or assist one or more buffing modules in buffing the component.

The vision module 102 is comprised of a vision system 114 and a computing device 112. The computing device 112 includes one or more processors, memory, and other components known in the field allowing a computing device to convert images captured by the vision system 114 into useable information to identify a component, a component position, a component, orientation, and/or a component size and to provide instructions to one or more of the buffing modules to appropriately buff the component. A logical connection, which may be wired or wireless, connects the computing device 112 to one or more elements (e.g., vision system 114) of the system 100 and/or one or more modules of the system 100 to communicate information (e.g., data, instructions).

The vision system 114 includes an image detection device. Examples of an image detection device include, but are not limited to, a camera. The camera may be effective to capture an image in the visible light spectrum, ultraviolet (UV) light spectrum, infrared (IR) light spectrum, greyscale, color scale, as a two-dimensional image, as a three-dimensional image, as a still image, and/or as a motion image (e.g., video). The vision system 114 may include one or more light sources, as will be depicted in FIG. 6. The vision system 114 may be calibrated and/or capture a calibration object to aid the vision system 114 and/or the computing device 112 in determining a size, position, orientation, and/or identity of the component. The determined size, position, and/or orientation of the component to a known location of the system 100 allows for the system 100 to convey the component to one or more modules having a known location, position, and/or orientation for subsequent operations to be performed.

The sidewall buffing module 104 includes a first buffing mechanism 128 having a first brush 130 having a cylindrical form with a plurality of bristles extending outwardly from a rotational axis 134 of the first brush 130. A brush, as used herein, is a an implement having a central core with bristles extending from the core outwardly. An example of a brush is a cylindrical core having bristles extending outwards around an entire circumference of the core. This brush construction forms a cylindrical buffing tool that is able to rotate about a rotational axis exposing the bristles to a common surface to be buffed throughout the entire rotation. Alternative arrangements of the bristles and/or core are also contemplated.

The bristles may be formed from a variety of materials. Generally a bristle is a section of material with various levels of stiffness. A bristle may also have various cross sectional shapes as viewed in a plane perpendicular to the longitudinal length of the bristle. The cross section shape may be circular, square, ovular, irregular, rectilinear, triangular, and the like. The cross section shape may influence buffing characteristics of the brush. The material forming the bristle may also be adjusted. Examples of bristles include organic-based materials (e.g., hair, fur, feather, vegetable-based), metallic (e.g., brass, bronze, steel), and/or polymeric (e.g., nylon, polypropylene). The length of a bristle as it extends from a core may also be adjusted to change a buffing result of the brush. It is contemplated that any of the bristle configurations (e.g., material, size, shape) contemplated herein may be applied to any of the brushes also provided herein.

The first brush 130 is comprised of a plurality of bristles that extend outward from a core through which the rotational axis 134 extends. The plurality of bristles form a diameter 136 of the first brush 130. The diameter 136 is between 100 millimeters (mm) and 180 mm. This range allows for an effective surface velocity at the proposed rotational speeds (e.g., 500-1,500 RPM that will be discussed hereinafter) for the brush surface against the component to be buffed. In an exemplary aspect the diameter 136 is between 120 mm and 160 mm. In another exemplary aspect the diameter 136 is between 140 mm and 150 mm.

The first buffing mechanism 128 also includes a first brush rotational drive 132. The first brush rotational drive 132 may be a direct drive mechanisms connected directly to the first brush 130, as depicted. Alternatively, the first brush rotational drive 132 may be remotely coupled through one or more transmission couplings (e.g., belt, chain, gears). The first brush rotational drive 132 may be an electric motor, a hydraulic motor, or other mechanical actuator that converts energy into rotational energy. The first brush rotational drive 132 may have variable speeds at which it can operate. Those speeds in connection with the first brush 130 are 500 RPM to 3000 RPM. In yet another example, the contemplated rotational rate provided by the first brush rotational drive 132 is in a range of 1000-2400 RPM. In another example, the contemplated rotational rate of the first brush rotational drive 132 is 1400-2200 RPM. These contemplated rotational rates in connection with the brush sizes (e.g., 100 mm-180 mm) provided herein provide intended surface buffing for the contemplated component compositions (e.g., EVA). As will be discussed hereinafter, it is contemplated that a brush rotational speed may be varied along different portions of the component to be buffed. This variability in the rotational speed is related to a movement (non-rotational) rate of the brush as a whole relative to the component, as will be discussed hereinafter in greater detail. The speed of the first brush rotational drive 132 may be controlled by a computing device, such as the computing device 112.

Figure 8A:
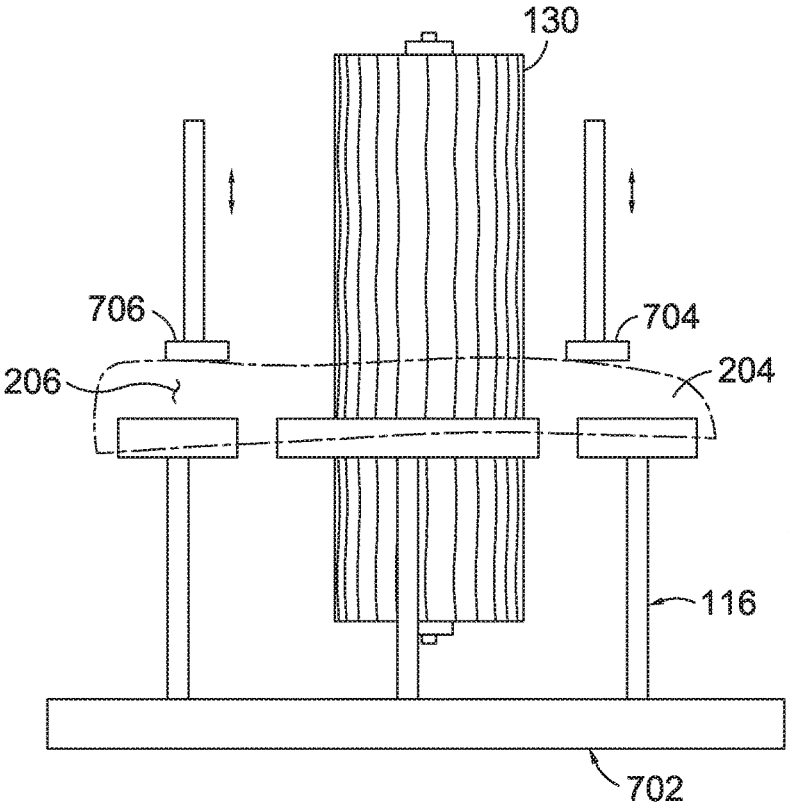
FIG. 8A depicts a side elevation view of the sidewall buffing module of FIG. 7, in accordance with aspects hereof.
Figure 8B:
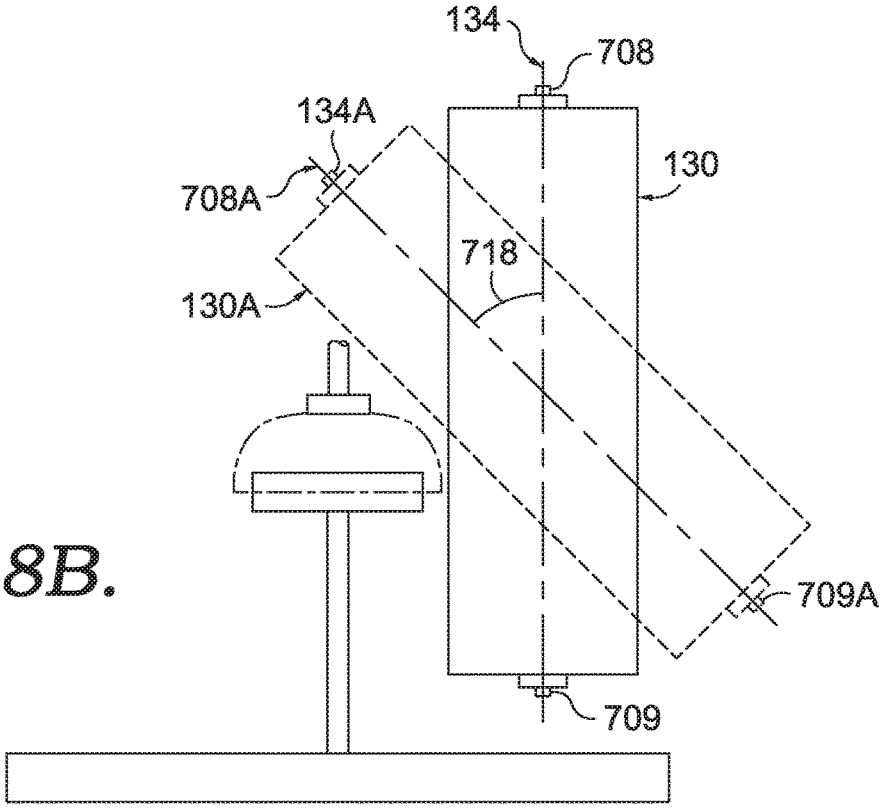
FIG. 8B depicts a front elevation view of the sidewall buffing module of FIG. 7, in accordance with aspects hereof.

In addition to adjusting a rotational speed of the first brush 130 at different locations relative to the component, it is also contemplated that an angle of the rotational axis 134 may be adjusted, as is depicted in FIG. 8B hereinafter. This adjustable angle of approach between the first brush 130 and the component allows for better conformance of the brush to the complex geometry of the component being buffed. Therefore, depending on a location of the component relative to the brush, the angle of the rotational axis 134 may be adjusted.

Figure 7:
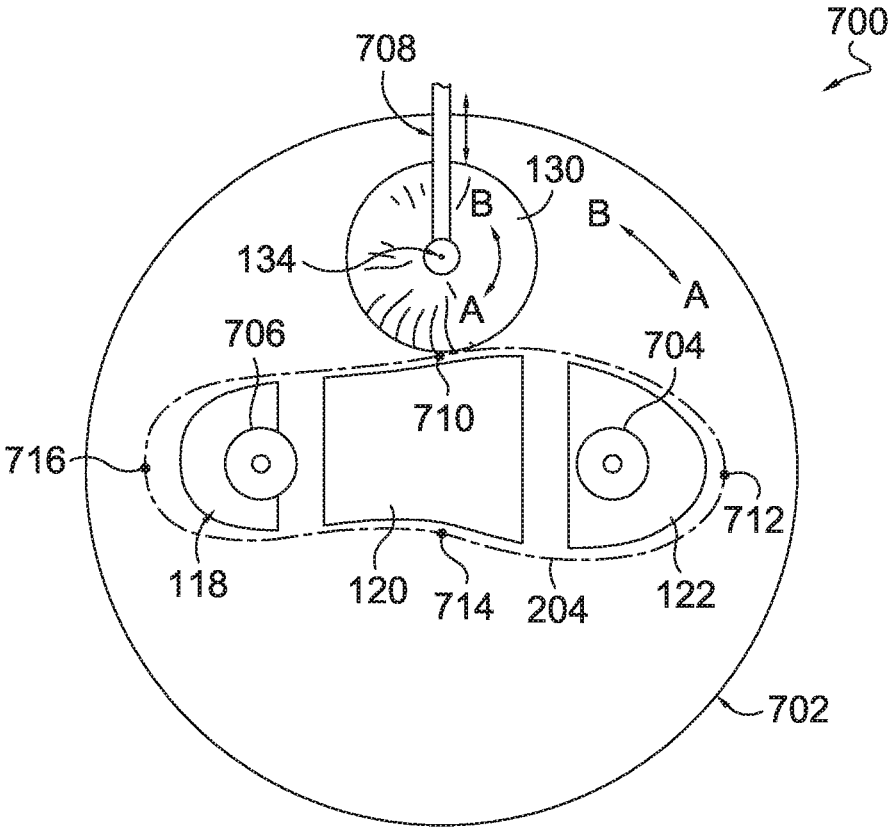
FIG. 7 depicts a top plan view of a sidewall buffing module, in accordance with aspects hereof.

Furthermore, it is contemplated that a depth of brush offset may be varied based on a relative location of the brush to the component. For example, the first brush 130 may have a an interaction where approximately 7 mm to 14 mm of the bristles interact with the component. Specifically, it is contemplated that in a first location 12-14 mm of bristles from the first brush 130 overlap (e.g., engage) with the component, but in another location 7-9 mm of bristles from the first brush 130 overlap with the component. Additionally, as is best depicted in FIG. 7, the first footwear component holder movement mechanism is capable of rotating during a buffing operation of a sidewall. The rate of rotation of the first footwear component holder movement mechanism may vary based on a relative location between the first brush 130 and the component. The rotational speed of the first footwear component holder movement mechanism may range, in an example, between 22-31 revolutions per minute (RPM). For example, in a first relative location between the first brush 130 and the component the first footwear component holder movement mechanism may rotate at 22-23 RPM and at a second location the first footwear component holder movement mechanism may rotate at 29-31 RPM based on the surface being buffed.

The sidewall buffing module 104 includes a first footwear component holder 116. The first footwear component holder 116 is comprised of a heel-end support 118, a midfoot support 120, and a toe-end support 122. Gaps are present between the various supports of the first footwear component holder 116. A first gap 124 and a second gap 126 are depicted. It is contemplated that any number of gaps at any size and/or location may be implemented. The gaps provide a first advantage in that they allow for individual adjustments of the support portions. For example, as the style, size, and/or shape of a footwear component being supported changes, the gaps allow for independent articulation and movement of the different support portions. Each support portion may be supported by a support element having adjustable characteristics (e.g., threaded elements, friction locking elements, pins, indents) that allow for changing of height, and relative position of the support portions. Another advantage of the gaps will be depicted in greater detail in FIG. 5 hereinafter, which allows a conveyance mechanism to deposit and retrieve a component to be buffed on the first footwear component holder 116.

The first footwear component holder 116, in an aspect, is moveable. For example, the first footwear component holder 116 may move through one or more movement mechanisms (e.g., actuator) in the X, Y, and/or Z direction. The first footwear component holder 116 may also rotate through one or more movement mechanisms about the X, Y, and/or Z axis. As such, it is contemplated that the first footwear component holder 116 may move and the first brush 130 may also move (and angularly adjust) in the X, Y, and/or Z directions. The movement of both of the first footwear component holder 116 and the first brush 130 allows for a faster throughput and greater flexibility in buffing complex shapes of a footwear component. The movement of the first footwear component holder 116 may be controlled by a computing device, such as the computing device 112.

As will be depicted in FIGS. 7-8, the sidewall buffing module 104 is also comprised of one or more clamping members effective to secure the component to be buffed with the first footwear component holder 116. The clamping members, in an exemplary aspect, compress the footwear component with the first footwear component holder 116.

The up surface buffing module 106 is comprised of a second brush 140 (also referred to as a rotational brush herein) having a cylindrical form with a plurality of bristles extending outwardly from a rotational axis 142. The second brush 140 has a diameter 146 as the bristles extend outwardly from a core through which the rotational axis 142 extends. The diameter 146 is between 100 mm and 180 mm. This range allows for an effective surface velocity at the proposed rotational speeds (e.g., 500-3,000 RPM) for the brush surface against the component to be buffed. In an exemplary aspect the diameter 146 is between 120 mm and 160 mm. In another exemplary aspect the diameter 146 is between 140 mm and 150 mm.

The second buffing mechanism also includes a second brush rotational drive 144. The second brush rotational drive 144 may be a direct drive mechanisms connected directly to the second brush 140, as depicted. Alternatively, the second brush rotational drive 144 may be remotely coupled through one or more transmission couplings (e.g., belt, chain, gears). The second brush rotational drive 144 may be an electric motor, a hydraulic motor, or other mechanical actuator that converts energy into rotational energy. The second brush rotational drive 144 may have variable speeds at which it can operate. Those speeds in connection with the second brush 140 are 500 RPM to 1500 RPM. In yet another example, the contemplated rotational rate provided by the second brush rotational drive 144 is in a range of 700-1400 RPM. In another example, the contemplated rotational rate of the second brush rotational drive 144 is 900-1300 RPM. These contemplated rotational rates in connection with the brush sizes (e.g., 100 mm-180 mm) provided herein provide intended surface buffing for the contemplated component compositions (e.g., EVA). As will be discussed hereinafter, it is contemplated that a brush rotational speed may be varied along different portions of the component to be buffed. This variability in the rotational speed is related to a movement (non-rotational) rate of the brush as a whole relative to the component, as will be discussed hereinafter in greater detail. The speed of the second brush rotational drive 144 may be controlled by a computing device, such as the computing device 112.

The rotational axis 142 extends in a direction perpendicular to that of the rotational axis 134 of the sidewall buffing module 104. This alternative direction of rotational axis reduces throughput time as a linear contact between the brush and the component may be maintained on the up surface rather than a rotational contact. Stated differently, the rotational axis of the brush is parallel to a plane in which the surface to buff generally extends, which allows for a higher throughput of the system with intended buffing results.

The up surface buffing module 106 is also comprised of a second footwear component holder 138. The second footwear component holder 138 is similar to the features already discussed with respect to the first footwear component holder 116. The second footwear component holder 138, in an aspect, is moveable. For example, the second footwear component holder 138 may move through one or more movement mechanisms (e.g., actuator) in the X, Y, and/or Z direction. The second footwear component holder 138 may also rotate through one or more movement mechanisms about the X, Y, and/or Z axis. As such, it is contemplated that the second footwear component holder 138 may move and the second brush 140 may also move in the X, Y, and/or Z directions. The movement of both of the second footwear component holder 138 and the second brush 140 allows for a faster throughput and greater flexibility in buffing complex shapes of a footwear component. The movement of the second footwear component holder 138 may be controlled by a computing device, such as the computing device 112.

Figure 9:
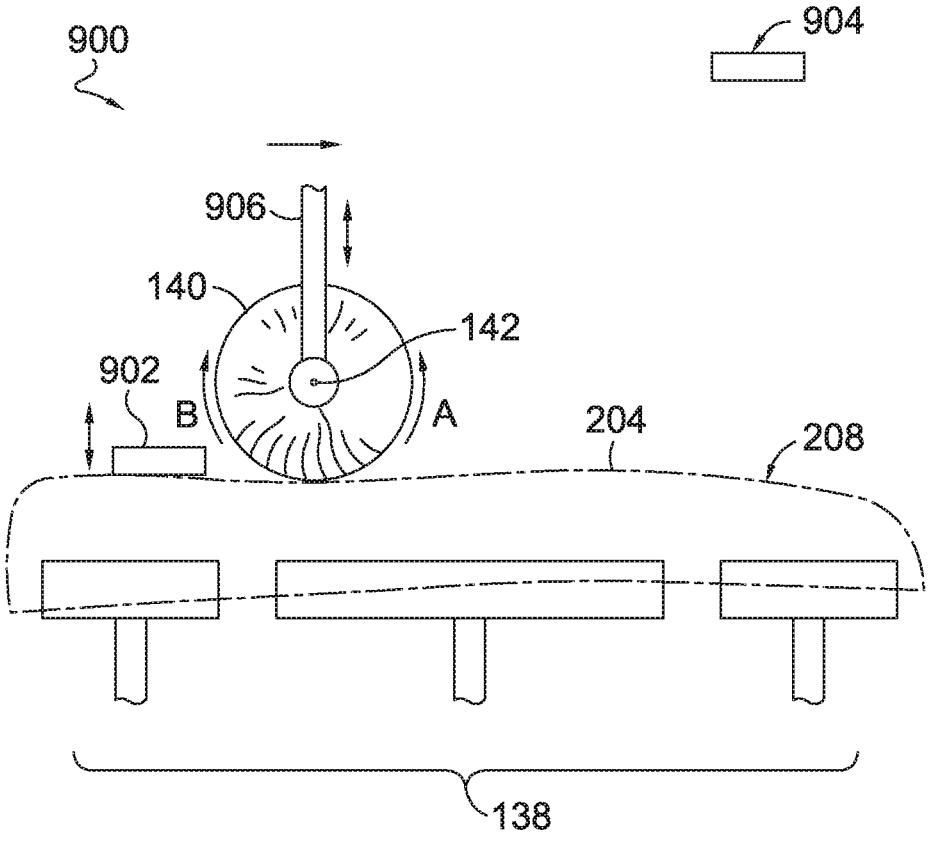
FIG. 9 depicts an elevation view of an up surface buffing module in a first configuration, in accordance with aspects hereof.
Figure 10:
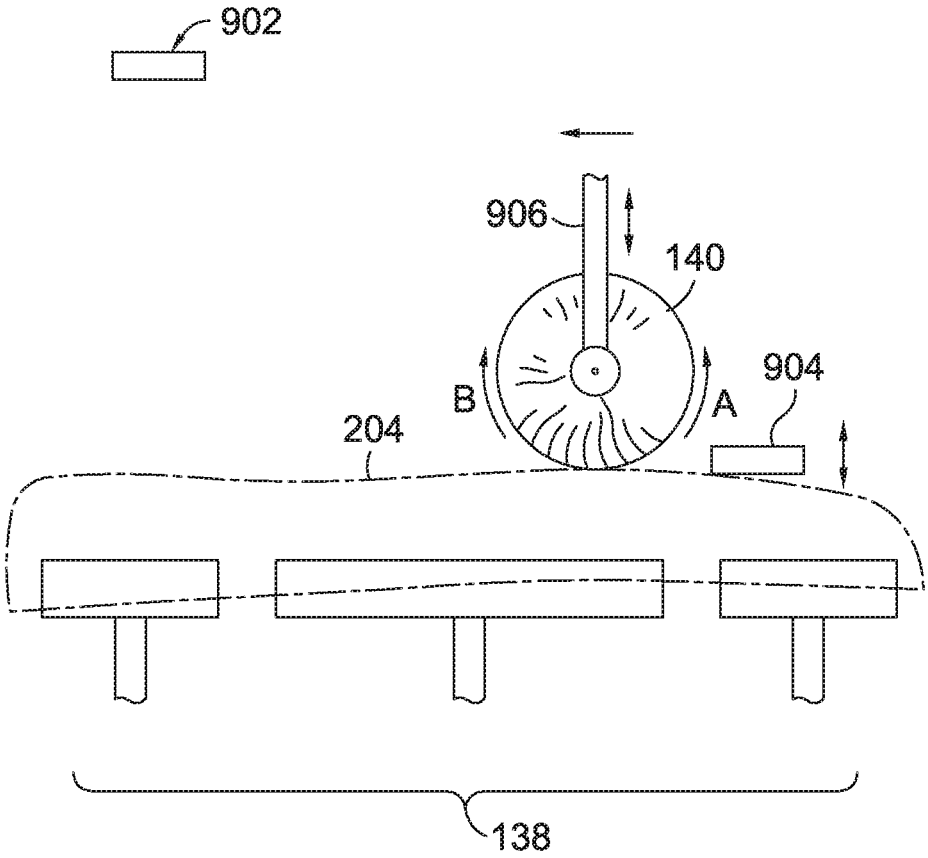
FIG. 10 depicts an elevation view of the up surface buffing module of FIG. 9 in a second configuration, in accordance with aspects hereof.
Figure 11:
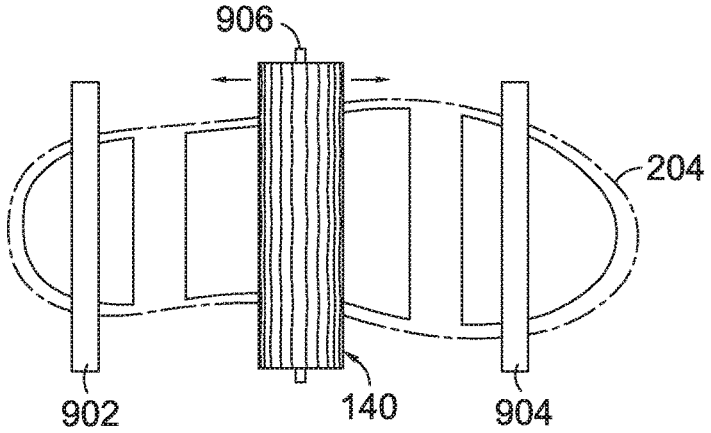
FIG. 11 depicts a top plan view of the up surface buffing module of FIG. 9, in accordance with aspects hereof.

As will be illustrated in greater detail in FIGS. 9-11, the up surface buffing module additionally includes one or more clamping members that selectively clamp the component to the second footwear component holder 138.

The down surface buffing module 108 is comprised of a third brush 152 having a cylindrical form with a plurality of bristles extending outwardly from a rotational axis 154. The third brush 152 has a diameter 156 as the bristles extend outwardly from a core through which the rotational axis 154 extends. The diameter 156 is between 100 mm and 180 mm. This range allows for an effective surface velocity at the proposed rotational speeds (e.g., 500-1,500 RPM) for the brush surface against the component to be buffed. In an exemplary aspect the diameter 156 is between 120 mm and 160 mm. In another exemplary aspect the diameter 156 is between 152 mm and 150 mm.

The third buffing mechanism also includes a third brush rotational drive (not shown). The third brush rotational drive may be a direct drive mechanisms connected directly to the third brush 152, as depicted. Alternatively, the third brush rotational drive may be remotely coupled through one or more transmission couplings (e.g., belt, chain, gears). The third brush rotational drive may be an electric motor, a hydraulic motor, or other mechanical actuator that converts energy into rotational energy. The third brush rotational drive may have variable speeds at which it can operate. Those speeds in connection with the third brush 152 are 500 RPM to 3000 RPM. In yet another example, the contemplated rotational rate provided by the third brush rotational drive is in a range of 700-1520 RPM. In another example, the contemplated rotational rate of the third brush rotational drive is 900-1300 RPM. These contemplated rotational rates in connection with the brush sizes (e.g., 100 mm-180 mm) provided herein provide intended surface buffing for the contemplated component compositions (e.g., EVA). As will be discussed hereinafter, it is contemplated that a brush rotational speed may be varied along different portions of the component to be buffed. This variability in the rotational speed is related to a movement (non-rotational) rate of the brush as a whole relative to the component, as will be discussed hereinafter in greater detail. The speed of the third brush rotational drive may be controlled by a computing device, such as the computing device 112.

The rotational axis 154 extends in a direction perpendicular to that of the rotational axis 134 of the sidewall buffing module 104. This alternative direction of rotational axis reduces throughput time as a linear contact between the brush and the component may be maintained on the down surface rather than a rotational contact. Stated differently, the rotational axis of the third brush 152 is parallel to a plane in which the surface to buff generally extends, which allows for a higher throughput of the system with intended buffing results.

The down surface buffing module 108 is also comprised of a series of rollers 148, 150. The rollers form a support surface defining a support plane 110 over which the footwear component passes during a down surface buffing operation. The rollers may be free rolling or they may be powered. For example, the rollers may rotate freely in response to a footwear article being conveyed over the rollers. Alternatively, the rollers may rotate in response to a drive source, such as an actuator to aid in passing the footwear component through the down surface buffing module 108. Each of the rollers include a rotational axis that is parallel with the rotational axis 154. The support plane 110 defined by the rollers 148, 150 may serve as a reference plane for elements of the down surface buffing module 108. For example, the rotational axis 154 is below the support plane 110. The bristles of the third brush 152 extend above the support plane 110 to effectively engage with a down surface of the footwear component being buffed. The compression plate 158 (discussed immediately below) is positioned above the support plane 110. The positioning of the various elements relative to the support plane 110 allows for the effective and intended buffing of the footwear component by the system 100.

The down surface buffing module 108 is also comprised of a compression plate 158. The compression plate 158 is effective to move in at least the Y and Z directions. Movement of the compression plate 158 is accomplished with one or more actuators which may be controlled by a computing device, such as the computing device 112. Movement in the Z direction allows for the compression plate 159 to compress the footwear component against the rollers 148, 150 and the third brush 152. This compression allows for effective buffing by the third brush 152 on the down surface of the footwear component. The compression plate 158 has a component-contacting surface 160, which may be textured to enhance engagement between the compression plate 158 and a footwear component as the footwear component is moved relative to the third brush 152 by the compression plate 158.

While a single processing line is depicted in FIG. 1 with system 100, it is contemplated that two or more lines may operate in the system 100. For example, a first line and a duplicate second line may operate in parallel to buff a right footwear component and a left footwear component. Where the first line has footwear component holders configured to support a "right" footwear component and the second line has footwear component holders configures to support a "left" footwear component.

While not depicted, it is contemplated that one or more logical connections are present between depicted component/elements of the system 100. For example, wired and/or wireless connections may exists between any of the component/elements of system 100 to effectively communicated and control the buffing operations. The logical connections allow the system 100 to adjust one or more parameters (e.g., brush position, brush position transition speed, support position, support speed, transfer speed, rotational speed, rotational direction, timing, clamp position, clamp activation).

Further, it is contemplated that one or more conveyance mechanisms may be included in portions of the system 100 to convey a footwear component to and from modules of the system 100. An exemplary conveyance mechanism will be discussed in connection with FIG. 5 hereinafter.

It is contemplated that one or more elements/components/modules of system 100 may be omitted. It is also contemplated that one or more elements/components/modules of system 100 may be arranged in an alternative relative position. It is contemplated that additional elements/components/modules may be included with the system 100.

Figure 2:
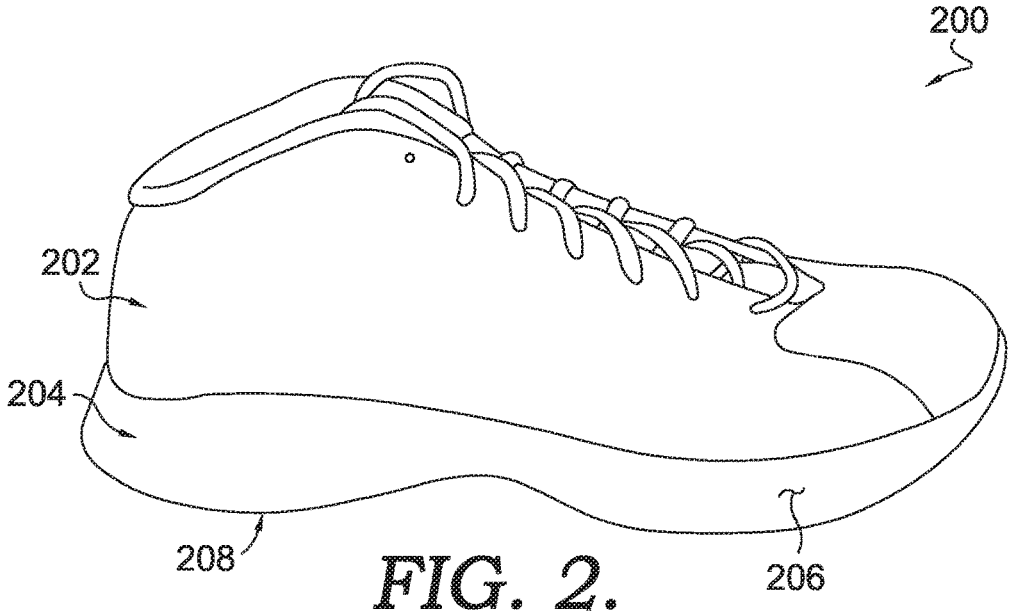
FIG. 2 depicts a perspective view of an exemplary article of footwear, in accordance with aspects hereof.

FIG. 2 depicts an exemplary article of footwear 200, in accordance with aspects hereof. The article of footwear 200 includes an upper 202 and a sole 204. The sole 204 has a sidewall 206 and a ground-facing surface 208. The sole 204 also has a foot-facing surface that is adjacent to the upper 202 and not numbered in FIG. 2. The foot-facing surface is opposite the ground-facing surface 208. While an athletic shoe is depicted, it is contemplated that an article of footwear may be any style of footwear, such as a sandal, slipper, boot, dress shoe, and the like.

The sole 204 may be a unitary sole formed from a homogenous material. The sole 204 may be a combination of an outsole and a midsole, where the outsole forms at least a portion of the ground-facing surface 208 and the midsole forms at least a portion of the foot-facing surface. The sole 204 may include additional elements, such as a gas-filled pockets (e.g., air bags), mechanical impact attenuation devices (e.g., compression springs). The sole 204 may be formed from a variety of materials such as EVA, PU, silicone, polypropylene, and the like. In an exemplary aspect, the sole 204 is formed, at least in part, with a injected and foamed EVA that is then buffed by the concept provided herein before final forming. In yet another example, the sole 204 is formed, at least in part, with an injected and foamed EVA that is at final shape before being buffed according to concepts provided herein.

Figure 3:
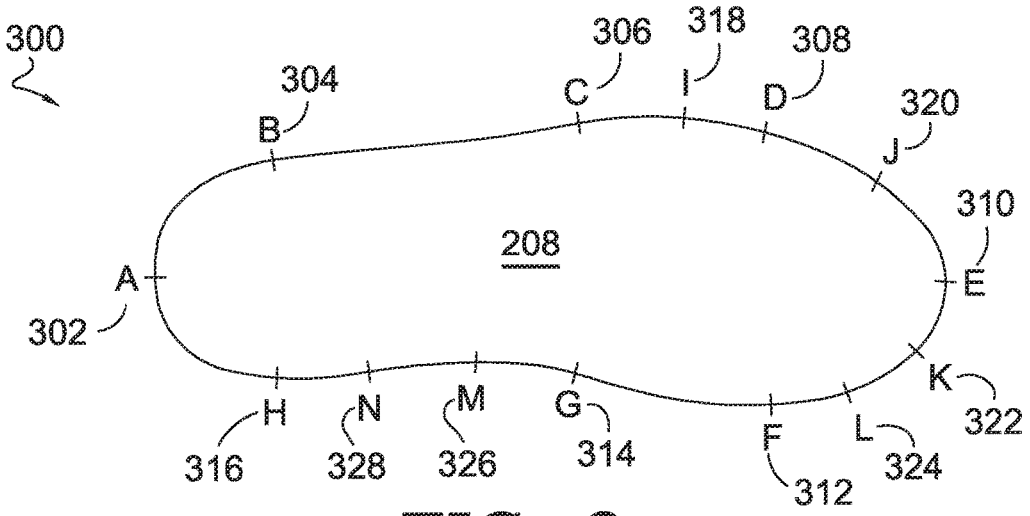
FIG. 3 depicts a bottom plan view of a sole portion for an article of footwear, in accordance with aspects hereof.

FIG. 3 depicts a bottom plan view 300 of the ground-facing surface 208 of the sole 204 of FIG. 2, in accordance with aspects hereof. The view 300 includes reference markets A-H that are mere references and not actually included in the ground-facing surface 208. Reference A 302, reference B 304, reference C 306, reference D 308, reference E 310, reference F 312, reference G 314, and reference H 316 are provided. Reference A 302 is at a heel end, reference E 310 is at a toe end, reference C 306 is at a lateral side, and reference G 314 is at a medial side of the article of footwear 200 of FIG. 2. Additional specific references are also depicted, such as a reference I 318, a reference J 320, a reference K 322, a reference L 324, a reference M 326, and a reference N 328. The various reference points may be referred to based on an angular position of the sole 204 relative to a central point. In an example, reference C 306 may represent 0 degrees (or 360 degrees) and each point in a clockwise direction is relative to reference C 306. For example, the reference E 310 is 90 degrees, reference G 314 is 180 degrees, and reference A 302 is 270 degrees. Continuing this example, reference I 318 is about 10 degrees, reference J 320 is about 60 degrees, reference K 322 is about 100 degrees, reference L 324 is 120 degree, reference M 326 is about 200 degrees, and reference N 328 is about 210 degrees. Specific segments between reference I 318 and reference J 320, between reference K 322 and reference L 324, and between reference M 326 and reference N 328 will be discussed hereinafter. Each of these specific segments, in an example, provide advantages to adjusting one or more buffing variables to achieve an intended buffing result given the geometry of the sole 204 at each of those segments. As will be provided hereinafter, some operations of the system 100 of FIG. 1 operate at different movement speeds, rotational speeds, brush angles, and rotational directions in response to a location at which the buffing operation is occurring. In those examples, the references of FIG. 3 will be referenced as examples for illustration purposes.

Figure 4:
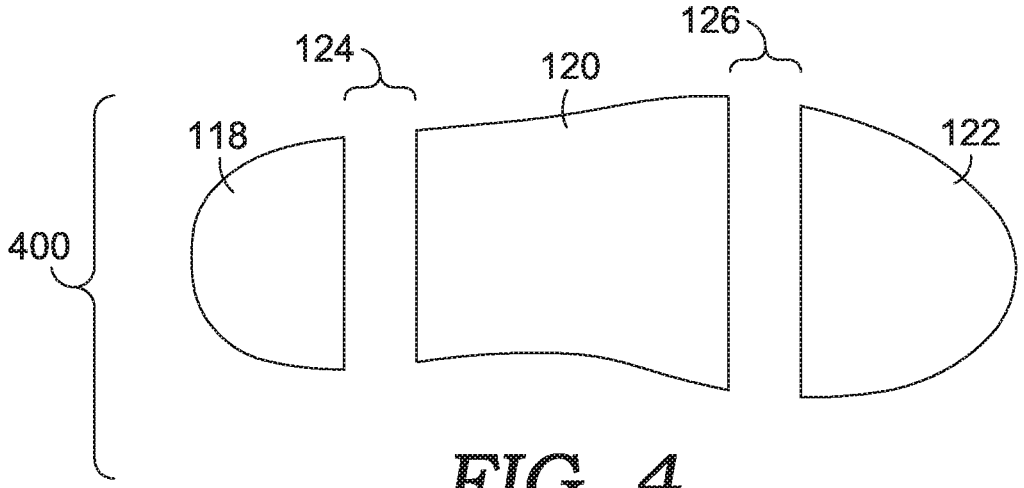
FIG. 4 depicts a top plan view of an exemplary footwear component holder, in accordance with aspects hereof.

FIG. 4 depicts a top plan view of an exemplary footwear component holder 400, in accordance with aspects hereof. The footwear component holder 400 is an enlarged and plan view of the elements discussed in FIG. 1 with respect to the first footwear component holder 116. As previously indicated, it is contemplated that the footwear component holder 400 may have any number of supports of any size/shape.

The heel-end support 118, the midfoot support 120, and the toe-end support 122 may be formed from any material. In aspects the supports are formed from a polymer material or a metallic material. The size, shape, orientation, and spacing of the supports may vary depending on the footwear component to be buffed by the system. The gaps 124 and 126 may be adjusted to accommodate different sizes of footwear components. The adjustment of the gaps 124 and 126 may be limited such that sufficient support is provided by the supports for buffing operations (e.g., the gaps may not increase beyond a size sufficient to maintain dimensional stability of the footwear component during buffing). The size of the gaps may further be limited such that they are maintained above a size needed for one or more elements of a conveyance mechanism to pass there through to deposit and/or retrieve the footwear component from the footwear component holder 400.

Figure 5:
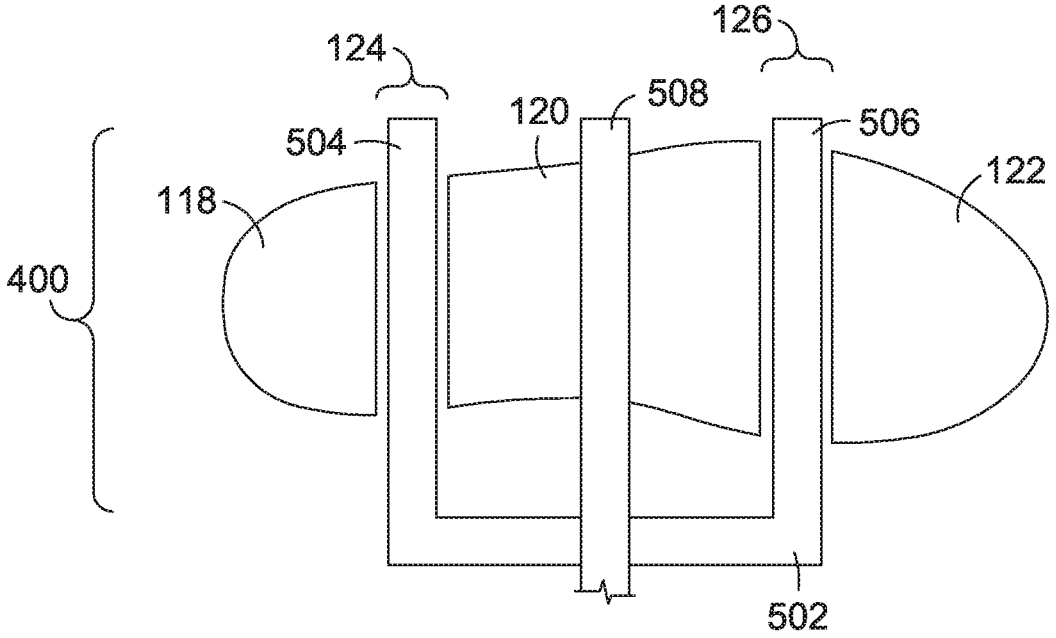
FIG. 5 depicts a top plan view of a clamping conveyance mechanism interacting with the footwear component holder of FIG. 4, in accordance with aspects hereof.

FIG. 5 depicts the footwear component holder 400 of FIG. 4 with a conveyance mechanism 502 interacting therewith, in accordance with aspects hereof. In this example, the conveyance mechanism 502 includes a lower fork having a first tine 504 and a second tine 506 that pass through the gaps 124 and 126, respectively. The conveyance mechanism 502 also includes an upper tine 508. The conveyance mechanism 502 is moveable in an X, Y, and/or Z direction as well as rotational about each of those directions. The lower tines 504, 506 and the upper tine 508 are effective to compress the footwear component there between to effectively deposit, transfer and retrieve the footwear component. The spacing between the first tine 504 and the second tine 506 coordinates with a spacing between the first gap 124 and the second gap 126 such that the first tine 504 and the second tine 506 may both pass through the respective gaps to deposit and/or retrieve the footwear component. The compressive grasp of the footwear component by the conveyance mechanism 502 allows for a known position and orientation of the footwear component for depositing and positioning at various modules of the system provided herein.

The conveyance mechanism 502 is moveable within the system 100 of FIG. 1 through a variety of manners. For example, linear actuators, stepper motors, belts, chains, geared drives, and the like. Any combination of movement manners may be used to move in the X, Y, and/or Z directions. Further, any combination of movement manners may be used to generate a compressive force between the lower tines 504, 506 and the upper tine 508.

Figure 6:
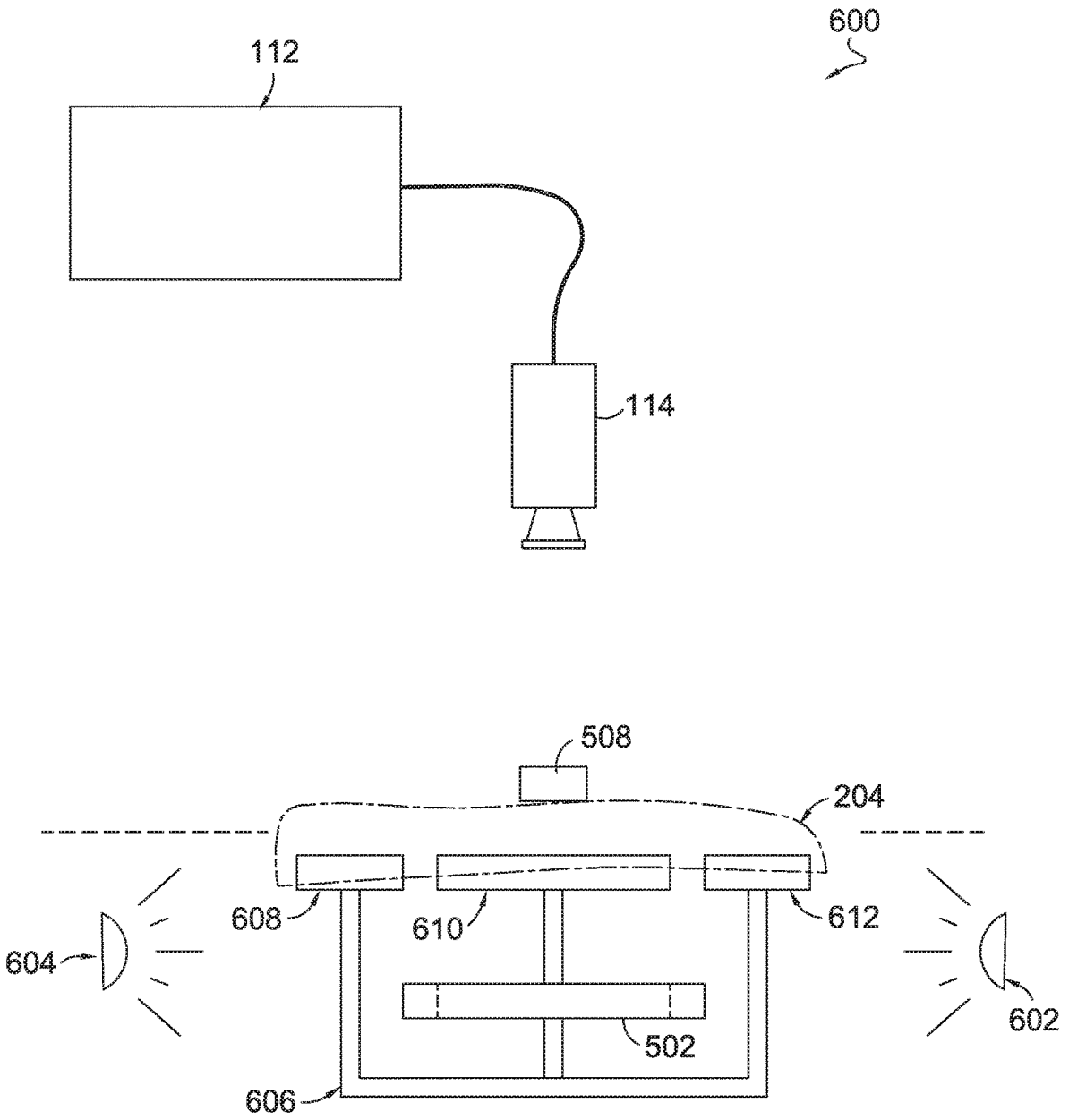
FIG. 6 depicts a schematic view of a vision system module, in accordance with exemplary aspects hereof.

FIG. 6 depicts a schematic view of a vision system module 600, in accordance with exemplary aspects hereof. The vision system module 600 is an enhanced depiction of the vision module 102 of FIG. 1. The vision system module 600 is comprised of the computing device 112, the vision system 114, a first illumination source 602, a second illumination source 604, a footwear component holder 606, the conveyance mechanism 502 and the sole 204 (depicted in dashed lines for illustration purposes).

The footwear component holder 606 includes a heel end support 608, a midfoot support 610, and a toe-end support 612. The elements of the footwear component holder 606 are similar to those similarly named elements of the first footwear component holder 116 of FIG. 1 and the footwear component holder 400 of FIG. 4. The lower tines of the conveyance mechanism are depicted as having passed through the gaps of the footwear component holder 606 to deposit the sole 204 on the footwear component holder 606. The upper tine 508 is depicted as compressing the sole 204 into the footwear component holder 606; however, it is contemplated that the upper tine 508 and the conveyance mechanism 502 may be moved altogether from a field of view of the vision system 114 in aspects.

The first illumination source 602 and the second illumination source 604 may be any appropriate illumination source for the vision system 114 (e.g., UV light emitting, IR light emitting, visible light spectrum emitting). Further, while depicted below the up surface of the sole 204 (i.e., the ground-facing surface 208 of FIG. 2), it is contemplated that one or more illumination sources may be above the sole 204. The location of the illumination sources below the up surface (i.e., the surface being captured by the vision system 114) allows for a contrast to be generated of the sole 204. The sole 204 perimeter will generate a luminescent contrast with the absence of additional illumination from the illumination sources on the up surface relative to the additional illumination below the sole 204 form the illumination sources. This contrast provides for enhanced shape detection by the vision system 114. While two discrete illumination sources are depicted, it is contemplated that any number of light sources may be implemented in any location.

The vision system module 600 is contemplated as capturing one or more images of the sole 204 to identify one or more characteristics of the sole 204. The characteristics may include, but are not limited to size, shape, style, position, orientation, identifiers (e.g., bar code), and the like. The determined characteristics are useable by the system 100 of FIG. 1 to control the buffing and general operation of the system 100 of FIG. 1. For example conveyance mechanisms can be instructed where to grasp the footwear component from the footwear component holder 606 such that the footwear component is appropriately poisoned at future footwear component holders. The system can also use the determinations from the vision system module 600 to determine parameters of future buffing operation (e.g., location, speed, direction, pressure) at different modules of the system.

While a specific arrangement of elements and components are depicted with FIG. 6, it is contemplated that any combination of components may be used. Additionally, it is contemplated that additional elements and components may be integrated with the vision system module 600.

FIGS. 7, 8A, and 8B depict enhanced views of the sidewall buffing module 104 from FIG. 1, in accordance with aspects hereof. FIG. 7 depicts a top plan view of a sidewall buffing module 700, in accordance with aspects hereof. As indicated above, the sidewall buffing module 700 is an enhanced view of the features discussed in connection with the sidewall buffing module 104 of FIG. 1. Additionally depicted in FIG. 7 is a first brush movement mechanism 708. The first brush movement mechanism is configured to move the first brush 130 in an X, Y, and/or Z direction. The first brush movement mechanism is also configured to move the first brush 130 at various angles relative to one or more elements, as is depicted in FIG. 8B hereinafter. The first brush movement mechanism 708 operates through an actuation, such as an electric actuator and/or a pneumatic actuator to adjust a position of the first brush 130. The actuation may be controlled by a computing device, such as the computing device 112 of FIG. 1. The first brush movement mechanism 708 may move the first brush 130 to apply an intended force at an intended angle of the first brush 130 against the sidewall of the footwear component, such as the sole 204 of FIG. 2.

The intended force may be described by an amount of brush depth interacting with the component. This level of interaction may be phrased in terms of a depth offset. The depth offset is an amount of bristle or brush overlapping the component as measured from a distal end of the bristle. The depth offset may be any amount, but it is contemplated as being around 10 mm in some locations of the first brush 130 relative to the component. In other locations it is contemplated that the first brush 130 has a first depth offset (e.g., 12-14 mm) between reference I 318 and reference J 320 of FIG. 3, the first brush 130 has a second depth offset (e.g., 7-9 mm) between reference K 322 and reference L 324 of FIG. 3, and the first brush 130 has a third depth offset (e.g., 10 mm) between reference M 326 and reference N 328 of FIG. 3. In this example, based on the complex curvatures of a footwear article at the provided segments, the depth offset of the first brush 130 is adjusted to achieve a sufficient buffing result. Alternative depth offsets and locations are contemplated and mat be implemented independently.

The sidewall buffing module 700 also includes a first footwear component holder movement mechanism 702. The first footwear component holder movement mechanism 702 is effective to move the first footwear component holder in an X, Y, and/or Z direction as well as (or alternatively) to rotate the first footwear component holder about the X, Y, and/or Z direction. As depicted in FIG. 1, the first footwear component holder movement mechanism 702 is effective to rotate the first footwear holder around the Z direction. The speed of rotation by the first footwear component holder movement mechanism 702 is variable. As such, it is contemplated that the first footwear component holder movement mechanism 702 may rotate at a first speed for a first portion of the footwear component (e.g., a relatively straight section of the footwear component, such as between reference B 304 of FIG. 3 and reference D 308 of FIG. 3) and the first footwear component holder movement mechanism 702 may rotate at a second speed (e.g., slower than the first speed) for a second portion of the footwear component (e.g., a curved portion of the footwear component, such as between reference D 308 of FIG. 3 and reference F 312 of FIG. 3).

In a specific example, it is contemplated that the first footwear component holder movement mechanism 702 rotates in a clockwise manner (e.g., "A" direction in FIG. 7) at first rate (e.g., 22-23 RPM) between reference I 318 and reference J 320 of FIG. 3, the first footwear component holder movement mechanism 702 first footwear component holder movement mechanism 702 rotates at a second rate (e.g., 19-20 RPM) between reference K 322 and reference L 324 of FIG. 3, and the first footwear component holder movement mechanism 702 rotates at a third rate (e.g., 29-31 RPM) between reference M 326 and reference N 328 of FIG. 3. In this example, based on the complex curvatures of a footwear article at the provided segments, the rotational speed of the first footwear component holder movement mechanism 702 is adjusted to achieve a sufficient buffing result. Alternative rates and locations are contemplated and mat be implemented independently.

A direction that the first footwear component holder movement mechanism 702 rotates about an axis in the Z direction also is related to a direction the first brush 130 rotates about the rotational axis 134. It is contemplated that the first brush 130 rotates in a first direction (e.g., clockwise) while the first footwear component holder movement mechanism 702 rotates in an opposite direction (e.g., counterclockwise). This opposite rotation has an effect of reducing the speed that the first brush 130 interacts with footwear component and pushes brushed residual to a portion ahead of the brush. Alternatively, it is contemplated that the first brush 130 rotates in a first direction (e.g., clockwise) and the first footwear component holder movement mechanism 702 rotates in a common direction. This configuration results in the brushed residual from the footwear component being expelled behind the brushed surfaces, which may prevent unintended abrasion from the brushed residual to achieve a consistent buffing.

As previously provided, it is contemplated that the first brush 130 may rotate at variable speeds (e.g., 2, 3, 4, 5, 6, or more discrete speeds). This variable speed of rotation may be selected to result in a consistent number of brush revolution per footwear component portion. For example, it is contemplated that the first brush 130 may rotate at a first speed for a first portion of the footwear component (e.g., a relatively straight section of the footwear component, such as between reference B 304 of FIG. 3 and reference D 308 of FIG. 3) and the first brush 130 may rotate at a second speed (e.g., slower than the first speed) for a second portion of the footwear component (e.g., a curved portion of the footwear component, such as between reference D 308 of FIG. 3 and reference F 312 of FIG. 3). Therefore, a coordination between the first brush rotation speed, the rotation of the first footwear component holder movement mechanism 702, and the first brush movement mechanism 708 provides a more uniform and intended buffing result.

In a specific example, it is contemplated that the first brush 130 rotates in a clockwise manner (e.g., "A" direction in FIG. 7) at first rate (e.g., 1300-1500 RPM) between reference I 318 and reference J 320 of FIG. 3, the first brush 130 rotates at a second rate (e.g., 2100-2300 RPM) between reference K 322 and reference L 324 of FIG. 3, and the first brush 130 rotates at a third rate (e.g., 1700-1900 RPM) between reference M 326 and reference N 328 of FIG. 3. In this example, based on the complex curvatures of a footwear article at the provided segments, the rotational speed of the first brush 130 is adjusted to achieve a sufficient buffing result. Alternative rates and locations are contemplated and mat be implemented independently.

The variability in speed of the first brush 130 as provided through the first brush rotational drive 132 allows for a consistent buffing of the sidewall to occur. Because of the complex curves and non-linear surfaces of the sole 204, the first brush 130 is not moved along the sidewall at a consistent rate. Because the movement of the first brush 130 along the sidewall is inconsistent, a consistent rotational rate of the first brush 130 would result in excessive buffing to occur in those locations where the first brush 130 more slowly traverses the sidewall and/or result in under buffing to occur in those locations where the first brush 130 more quickly traverses the sidewall. As such, in some aspects there is a positive correlation between the rate of the first brush 130 traversing a surface to be buffed and the rotational rate of the first brush 130. Stated differently, where the first brush has a greater rate of movement along the buffing surface of the footwear component, the rotation rate of the first brush is greater relative to a portion of the footwear component where the first brush 130 has a lesser rate of movement. Additionally, the variable rate of brush rotation also allows for variability in buffing effect created by the first brush 130.

For example, in locations where additional buffing is to be performed (e.g., from detection by a vision system, such as the vision module 102), the rotation speed of the first brush 130 may be increased from a standard rate to result in a greater number of revolutions of the cylindrical brush in the area identified for additional buffing.

FIG. 8A depicts a side elevation view of the sidewall buffing module 700 of FIG. 7, in accordance with aspects hereof. As best seen in the FIG. 8A view of the sidewall buffing module 700, a first clamp 704 and a second clamp 706. The clamps 704, 706 have clamping surfaces that contact and compress the sole 204 to secure the sole 204 to the first footwear component holder 116 for a buffing operation by the first brush 130. Each of the first clamp 704 and the second clamp 706 are independently moveable in a first aspect. Alternatively, the first clamp 704 and the second clamp 706 are moveable in concert. As depicted in FIG. 8A, the clamps move in a linear manner along the Z axis to generate the compressive force on the sole 204. Not depicted but contemplated is a movement mechanism that moves in coordination with the first footwear component holder movement mechanism 702. As such, the clamps may move and maintain the compressive force on the sole 204 as the first footwear component holder movement mechanism 702 moves the first footwear component holder 116 during a buffing operation. Stated differently, it is contemplated that a movement mechanism associated with the first clamp 704 and the second clamp 706 is synchronized with the movement of the first footwear component holder movement mechanism 702. This synchronized movement allows the footwear component to be repositioned relative to the first brush 130 during a buffing operation while remaining secured to the first footwear component holder 116 by the clamps.

FIG. 8B depicts a front elevation view of the sidewall buffing module 700 of FIG. 7, in accordance with aspects hereof. Specifically depicted is an angular adjustability of the first brush 130 as depicted by the alternative position of the first brush 130 as the angled first brush 130A. The angular variability of the first brush 130 by an angle 718 allows the sidewall buffing module 700 to better compensate for and adjust a kickback force that can be generated between the bristles of the first brush 130 and the component when a perpendicular intersection occurs between the component (e.g., sidewall) and the bristles. By introducing the angle 718, the interaction between the first brush 130 and the component is in a non-perpendicular manner allowing for the bristles of the first brush 130 to convert forces generated between the first brush 130 and the component to a buffing force rather than a force translated through the first brush 130 (e.g., a kickback force). Additionally, the angle 718 allows for an interaction between more portions of the component transitioning away from the sidewall portion. As such, a transition between the various modules of the system may be achieved, in an aspect. The elements of FIG. 8B that end in an "A" represent an angled version of the similarly numbered features. For example, angled first brush 130A is an angled depiction of the first brush 130. Similarly, a rotational axis 134A is an angled depiction of the rotational axis 134.

The sidewall buffing module 700 of FIGS. 7, 8A, and 8B are adapted to perform a buffing operation on a footwear component, such as the sole 204. The operation may be expressed as a series of steps. Initially, the footwear component is compressed between a support surface (e.g., heel-end support 118, midfoot support 120, toe-end support 122) and a clamp surface (e.g., first clamp 704, second clamp 706). The process continues with contacting the first brush 130 with the footwear component at a first location (e.g., heel end, toe end). The first brush 130 is rotating at a first rate while contacting the footwear component in the first location. The footwear component is repositioned relative to the first brush 130, such as traversing along the sidewall surface. This repositioning may occur through motion created by the first footwear component holder movement mechanism 702 rotating about an axis that is parallel to the rotational axis 134 of the first brush 130. Additionally or alternatively, the repositioning occurs through a linear movement of the first brush 130 by way of the first brush movement mechanism 708. The repositioning allows for the first brush 130 to contact the sole 204 at a second location that is different from the first location. The second location may be a medial side or lateral side of the sole 204 in a midfoot region. The first brush 230 is rotated at a second rate while the first brush 130 is in contact with the second location. The second rotational rate may be a faster rotational rate than the second rate. As previously discussed, this may be a result of the first brush 130 traversing the sidewall portion including the second location at a faster rate than the portion of the sidewall having the first location.

FIGS. 9 and 10 depict enhanced views of the up surface buffing module 106 from FIG. 1, in accordance with aspects hereof. Specifically, FIG. 9 depicts an elevation view of the up surface buffing module 106 of FIG. 1 in a first configuration, in accordance with aspects hereof. The second footwear component holder 138 is depicted having the sole 204 supported thereon. Also depicted is a first clamp 902 and a second clamp 904. The second brush 140 having the rotational axis of 142 is depicted as having a second brush movement mechanism 906 effective to move the second brush 140 in at least a Z direction, but is it also contemplated that the second brush movement mechanism may move the second brush 140 in or around the X, Y, and/or Z direction in some aspects.

The first clamp 902 is depicted in a clamped position in FIG. 9 while the second clamp 904 is in an unclamped position. A clamped position is a relationship between the clamp and the footwear component holder such that a compressive force is exerted on the footwear component between the clamp and the component holder to secure the footwear component. In an unclamped position the clamp and the component holder (e.g., a support surface) are not relatively positioned to exert a maintaining compressive force on the footwear component. Movement of the first clamp 902 and the second clamp 904 is achieved through a movement mechanism, such as an actuator, that is effective to position the clamp in a clamped or unclamped position. Control of the movement mechanism is by a computing device, such as the computing device 112 of FIG. 1. Alternatively, the transition between clamped and unclamped positions is achieved through a manual operation. The movement of the clamps in the up surface buffing module may be in a Z direction, but it is also contemplated that the clamps may move/rotate in the X, Y, and/or Z directions. The first clamp 902 clamps a heel end of the sole 204 while the second clamp 904 is effective to clamp a toe end of the sole 204.

The second brush 140 is repositioned along the up surface (the ground-facing surface 208 when in an as-worn configuration) of the sole 204 during a buffing operation to buff the up surface. This repositioning of the second brush 140 is accomplished by the second brush movement mechanism 906 that is effective to move in at least the Y and Z directions, as depicted in FIG. 9. It is additionally contemplated that the second brush movement mechanism 906 is effective to move/rotate the second brush 140 along or around the X, Y, and/or Z directions. The second brush movement mechanism 906 operates with a movement mechanism, such as an actuator, that operates at a controlled speed and location. The speed and/or location control may be instructed from a computing device, such as the computing device 112 of FIG. 1.

The second brush movement mechanism 906 is effective to exert a force through the second brush 140 to the sole 204. The force may be adjusted to achieve an intended buffing result. In some aspects, the second brush movement mechanism 906 applies a force that results in a 2-3 kilograms of pressure per cubic centimeter to the footwear component. In this example, the second brush is comprised of nylon bristles. The 2-3 $kg/cm^3$ of pressure is an effective amount of pressure to achieve a sufficient buffing result on an EVA article, in an exemplary aspect. This also results in about 5 mm of interaction between the bristles and the footwear component. Stated differently, the second brush 140 is positioned such that the footwear article is about 15 mm within the radius of the second brush 140. For example, if the second brush 140 has a diameter of 145 mm (a radius of 72.5 mm), the footwear article is positioned about 67.5 mm from the rotational axis 142 of the second brush 140, in an exemplary aspect. It is appreciated that any offset distance may be used and it will vary based on material to be buffed, brush material, buffing results intended, brush rotation speed, brush movement speed, and the like. It is understood that any pressure may be applied. It is also understood that any amount of bristle interaction (e.g., depth of component interaction into the bristles) is contemplated.

An offset distance may be expressed as a distance from the support surface of the second footwear component holder 138 from a system perspective. For example, while the above examples recites a distance that the footwear component extends into the brush bristles, the same concept may be expressed from a system perspective where that same location of the brush may be measured relative to the support surface of the footwear component holder. Stated differently, achieving a specific inset of a known footwear article into the bristles of a brush also results in a known offset of that same brush from the support surface of the footwear component holder supporting the footwear component.

As depicted in FIG. 1, the second brush 140 rotates about the rotational axis 142 by the second brush rotational drive 144. The second brush rotational drive 144 is effective to rotate the second brush 140 in a first direction (e.g., counterclockwise as depicted in a "A" direction in FIG. 9) or in a second direction (e.g., clockwise as depicted in a "B" direction in FIG. 9). During a buffing operation of an up surface, it is contemplated that the second brush 140 rotates in a first direction for a first portion of the up surface and the second brush 140 rotates in a second direction for a second portion of the up surface.

This variable direction of rotation allows for the secured maintaining of the footwear component during the buffing operation. As is depicted in FIG. 9, the second brush 140 is buffing a heel end of the sole 204 while the first clamp 902 is securing the heel end of the sole. In this example, the second brush 140 may rotate in the counterclockwise direction as the brush is moved from the heel end to the toe end. This rotational direction imparts a tensile force in the relatively pliable sole 204. A tensile force aids in maintaining the sole 204 secured against the support surface of the second footwear component holder 138. This is opposed to a compressive force that would be generated by a clockwise rotation of the second brush 140. The compressive force may, in some examples, lift the sole 204 from the second footwear component holder 138 and therefore reduce the effective securement provided by the first clamp 902. As will be seen in FIG. 10, when the second brush 140 is moved in the opposite direction of a toe to heel direction, the second brush 140 may be rotated in a clockwise direction to achieve a tensile force imparted into the sole 204. Therefore, it is contemplated that a relation is created between a direction of travel of the brush and the rotation direction of the brush. Stated differently, when the brush moves in a first direction, the brush rotates in a counterclockwise direction and when the brush moves in a second direction (opposite from the first direction), the brush rotates in a clockwise direction.

FIG. 10 depicts an elevation view of the up surface buffing module of FIG. 9 in a second configuration, in accordance with aspects hereof. In this second configuration, the second brush 140 is moving in a toe end toward a heel end direction from the toe end. As such, the first clamp 902 is in an unclamped position to prevent obstructing the second brush 140 from buffing the up surface. The second clamp 904 is in a clamped position clamping the sole 204 to the support surface of the second footwear component holder 138. As previously discussed, the second brush 140 may be rotated in a different rotational direction in FIG. 10 from a direction in which it rotates in FIG. 9 as a result of a different direction of travel of the second brush 140.

Additionally or alternatively, the direction of rotation may also be adjusted based on a proximity of the second brush 140 to the toe end or the heel end. Because the first clamp 902 and the second clamp 904 clamp the sole 204 at an intermediate position relative to the toe end and the heel end, the rotation movement of the second brush 140 may dislodge the sole 204 from the support surface during a buffing process as the portion of the sole 204 that extends between a terminal end (e.g., heel end or toe end) and the clamp for when that same terminal end is buffed. As such, a change in rotational direction for those portions that extend between a terminal end and clamp position may have an alternative rotational direction as other portions of the up surface, in an exemplary aspect.

FIG. 11 depicts a top plan view of the up surface buffing module of FIG. 9, in accordance with aspects hereof. The first clamp 902 and the second clamp 904 are depicted as extending across a width of the sole 204. One or more of the first clamp 902 and the second clamp 904 may be in a clamped or unclamped position at a given time. Additionally, while depicted in this example as a Z direction movement between a clamped position and an unclamped position, it is contemplated that the unclamped position may result in a rotation or movement about or in a different direction. Additionally, as seen in FIG. 11, the second brush 140 has a length in a longitudinal direction that is at least as wide as the footwear component to be buffed. This length allows for a reduced number of passes by the second brush 140 over the surface to be buffed.

The up surface buffing module is configured to perform a buffing operation on an up surface of the footwear article. The buffing operation may be expressed as a series of steps that include compressing the footwear component between a support surface of the second footwear component holder 138 and a clamp surface of the first clamp 902, as depicted in FIG. 9. The second brush 140 contacts the sole 204 at a first location, such as the toe end. The second brush 140 rotates in a first direction while contacting the sole 204 in the first location. The first direction of rotation may be in a counterclockwise direction in a first example or it may be in a clockwise direction in a second example. The steps continue with the second brush being conveyed along the surface to buffed. The first clamp 902 transitions into an unclamped position while the second clamp 904 transitions into a clamped position, as depicted in FIG. 10. The second brush 140 contacts the sole 204 in a second location that is different from the first location (e.g., the heel end). The second brush 140 is rotated in a second direction while the second brush 140 is at the second location. The second brush 140 is conveyed along at least a portion of the surface to be buffed while the second brush 140 is rotating in the second direction. In this example the brush may be conveyed in a first direction while rotating in a first direction and the brush may be conveyed in a second direction while the brush rotates in the second direction. However, the brush may rotate in both the first direction and/or in the second direction while being conveyed in a common direction along a surface of the sole 204.

Figure 12:
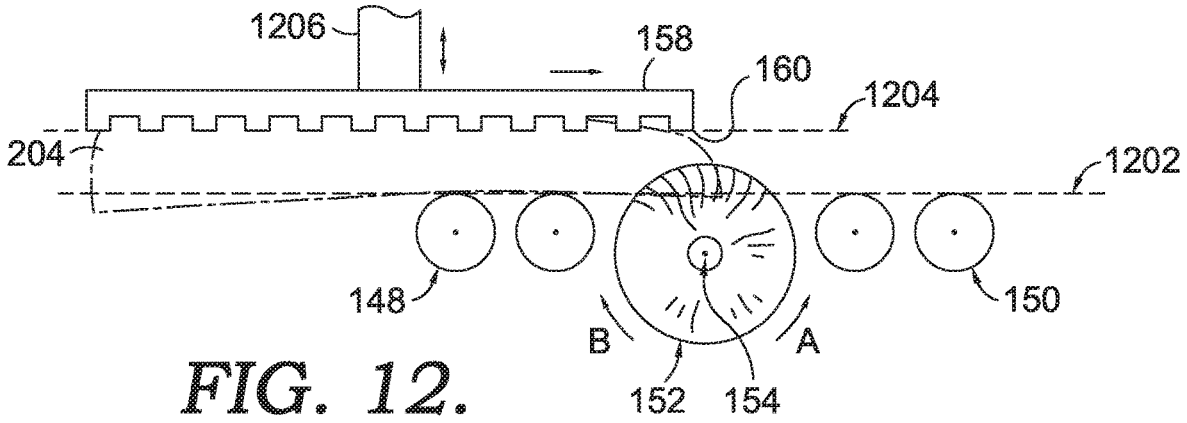
FIG. 12 depicts an elevation view of a down surface buffing module in a first configuration, in accordance with aspects hereof.
Figure 13:
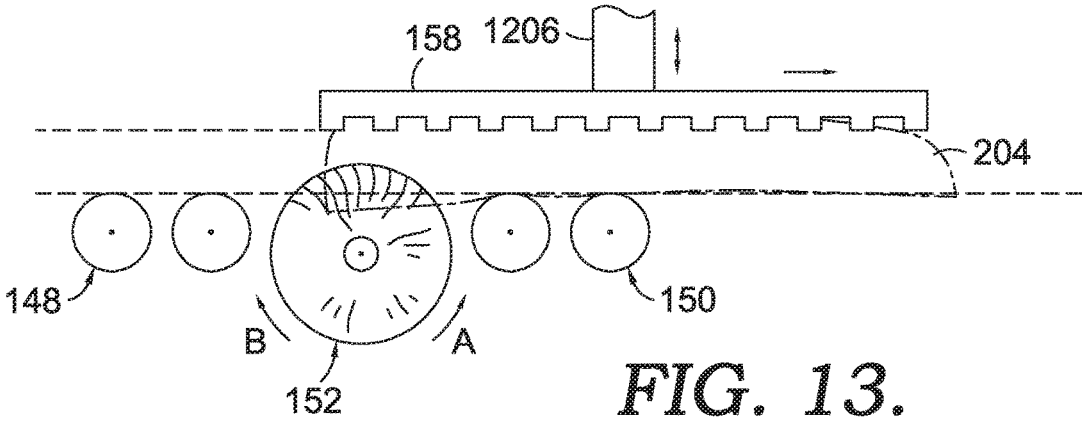
FIG. 13 depicts an elevation view of the down surface buffing module of FIG. 12 in a second configuration, in accordance with aspects hereof.

FIGS. 12-13 depict enhanced views of the down surface buffing module 108 from FIG. 1, in accordance with aspects hereof. Specifically, FIG. 12 depicts an elevation view of the down surface buffing module in a first configuration, in accordance with aspects hereof. The down surface buffing module as depicted in FIG. 12 provides the third brush 152 having the rotational axis 154. The third brush 152 is comprised of a plurality of bristles extending outwardly from the rotational axis 154. The outward extension of the bristles my extend from a core through which the rotational axis 154 extends. The third brush 152 is positioned between a plurality of rollers forming a footwear component holder. The rollers 148, 150 are exemplary rollers. Any number of rollers may be combined to form the footwear holder for the down surface buffing module. A support plane 1202 is formed from the supporting surfaces of the plurality of rollers 148, 150.

As depicted in FIG. 12, the rotational axis 154 is below the support plane 1202 while the bristles of the third brush 152 extend above the support plane 1202. The bristles of the third brush 152 extending above the support plane 1202 is advantageous for the sole 204 and buffing a foot-facing surface that is opposite the ground-facing surface of the sole 204 when in an as-worn configuration. The sole 204 forms a cup-like structure with the foot-facing surface recessed from the distal ends of the sidewall. Stated differently, the sidewalls of the sole 204 offset the foot-facing surface of the sole 204 away from the support plane 1202. The extension of the bristles above the support plane 1202 allows for the sole 204 to convey along the support plane 1202 while still allowing the bristles to meaningfully engage with the foot-facing surface that is offset from the support plane 1202 to effectively buff the foot-facing surface of the sole 204. The amount of extension by the bristles above (e.g. on an opposite side of the support plane 1202 from the rotational axis 154) the support plane 1202 may be adjusted based on an amount of offset between the support plane 1202 and the foot-facing surface as caused by the sidewall height, in an example.

The direction of rotation of the third brush 152 may be in either a counterclockwise manner (e.g., "A" direction in FIG. 12) or in a clockwise manner (e.g., "B" direction in FIG. 12). The third brush 152 is rotated by a third brush rotation mechanism, such as an actuator. The third brush rotation mechanism may be similar to that discussed as the second brush rotational drive 144 of FIG. 1. The third brush rotation mechanism may be controlled by a computing device, such as the computing device 112 of FIG. 1. The computing device may adjust one or more parameters, such as direction of rotation and rotation speed of the third brush 152. The computing device may adjust the direction of rotation, for example, based on a location of the sole 204 or the compression plate 158. For example, as the compression plate advances the sole 204 across the third brush 152, the third brush 152 may rotate in a first direction, such as a clockwise direction, for a portion of the sole 204. For a different portion of the sole 204 (e.g., a heel-end portion), the third brush 152 may rotate in an opposite direction (e.g., counterclockwise). The third brush 152 may rotate in a first direction for more than 50% of the compression plate 158 length passing the third brush 152 at the rotational axis 154 in a direction conveyance. The third brush 152 may rotate in a first direction for more than 75% of the compression plate 158 length passing the third brush 152 at the rotational axis 154 in a direction conveyance (e.g., material flow direction).

In an example, because the sole 204 is a cup-like sole structure, the direction of brush rotation may be selected to prevent the bristles from engaging with the sidewalls of the sole 204 to cause an interference with a surface to be brushed. For example, as the sole 204 is conveyed in a toe-to-heel direction, the brush may rotate in a clockwise manner as the toe end of the sole 204 approaches to prevent the toe-end sidewall from bending into the foot-facing surface of the sole 204. Stated differently, the bristles of the third brush 152 may engage with the toe-end of the sidewall and push the sidewall toward the heel end and therefore obscure a portion of the foot-facing surface of the sole 204 as the third brush 152 rotates in a counterclockwise manner. A similar obscuring of the foot-facing surface may occur when the third brush 152 rotates in a clockwise manner as the heel end of the sole 204 approaches the third brush 152. For this reason, some aspects contemplate changing a direction of rotation for the third brush 152 based on a location of the sole 204 relative thereto.

The down surface buffing module also includes a compression movement mechanism 1206 that is effective to move the compression plate 158 in a plane parallel to the support plane 1202. The compression movement mechanism 1206 may be an actuator, such as a linear actuator, a belt-drive, a chain-drive, a helical-drive, pneumatic drive, hydraulic drive, and the like. The compression movement mechanism 1206 may also move in the X, Y, and/or Z direction. For example, the compression movement mechanism 1206 is effective to move in the Z direction (i.e., perpendicular to the support plane 1202) to provide an effective compression of the sole 204 to the support plane 1202 and the third brush 152. This compression force provided by the compression movement mechanism 1206 may be measured as 2-3 $kg/cm^3$ at the sole 204. Additional ranges of force or pressure are contemplated, such as 1-5 $kg/cm^3$, in some examples.

FIG. 13 depicts an elevation view of the down surface buffing module of FIG. 12 in a second configuration, in accordance with aspects hereof. The second configuration is provided to demonstrate the direction of rotation of the third brush 152 rotating in an opposite direction from that which occurred in FIG. 12. For example, the third brush 152 may rotate in a counterclockwise direction as the heel end of the sole (and the associated portion of the compression plate 158 that is effectively maintaining the sole 204 in proximity to the third brush 152 while also moving the sole 204 in a material direction) approaches the third brush 152. The third brush 152 may rotate in the first direction for more than 75% of a length of the compression plate 158 to provide a continuous buffing pattern across a substantial portion of the sole 204 before changing a direction of rotation. This uneven distribution of rotation along a length of the compression plate can result in a more uniform buffing result for a great percentage of area being buffed by the down surface buffing module, in an exemplary aspect.

The compression plate 158 is depicted having the component-contacting surface 160 with a textured surface that forms a engagement plane 1204 for conveying the sole 204. The texturing may be of any style and degree. The texture, in an exemplary aspect, assists in creating a mechanical engagement between the compression plate 158 and the footwear component such that linear movement in the material-flow direction provided by the compression plate 158 is translated into a similar motion by the sole 204 even in response to a rotational motion of the third brush 152 acting on an opposite surface of the sole 204. Stated in an alternative way, the texturing of the component-contacting surface 160 provide more mechanical engagement to maintain the sole 204 with the compression plate 158 than is created between the third brush 152 as it is buffing the sole 204.

The down surface buffing module is effective to buff a down surface of a footwear component. The process of buffing the down surface of a footwear component by the down surface buffing module may be expressed in a series of steps that include compressing the footwear component between the compression plate 158 and the footwear component holder that is comprised of the plurality of rollers 148, 150. Each of the plurality of rollers 148, 150 have an axis of rotational that is parallel with the axis of rotation 154 of the third brush 152. The axis of rotation 154 is on a first side of the support plane 1202 formed by the plurality of rollers 148, 150. At least a portion of the bristles of the third brush 152 extend to a second side of the support plane 1202 for engagement with the footwear component. The steps include contacting at least a portion of the bristles of the third brush 152 with the footwear component in a first location (e.g., toe end) and rotating the third brush 152 in a first direction at the first location. The steps additionally include conveying the article along the support plane 1202 by a linear movement of the compression plate 158. This conveyance moves the footwear component in a first direction from the first location to a second location. At the second location, the third brush 152 rotates in a second direction while buffing the footwear component. During the buffing operation, the third brush 152 may engage with the footwear component such that the footwear component at the first location extends at least 5 mm into the diameter of the third brush 152.

FIGS. 14-17 provide flow diagrams depicting various methods of buffing a component of footwear with the system provided herein. It is contemplated that additional steps may be included in the various methods. It is also contemplated that various steps may be omitted from the methods provided herein. Further yet, it is contemplated that various steps of the methods may be performed in different orders than depicted in the illustrated flow diagrams while still achieving a buffed footwear component.

Figure 14:
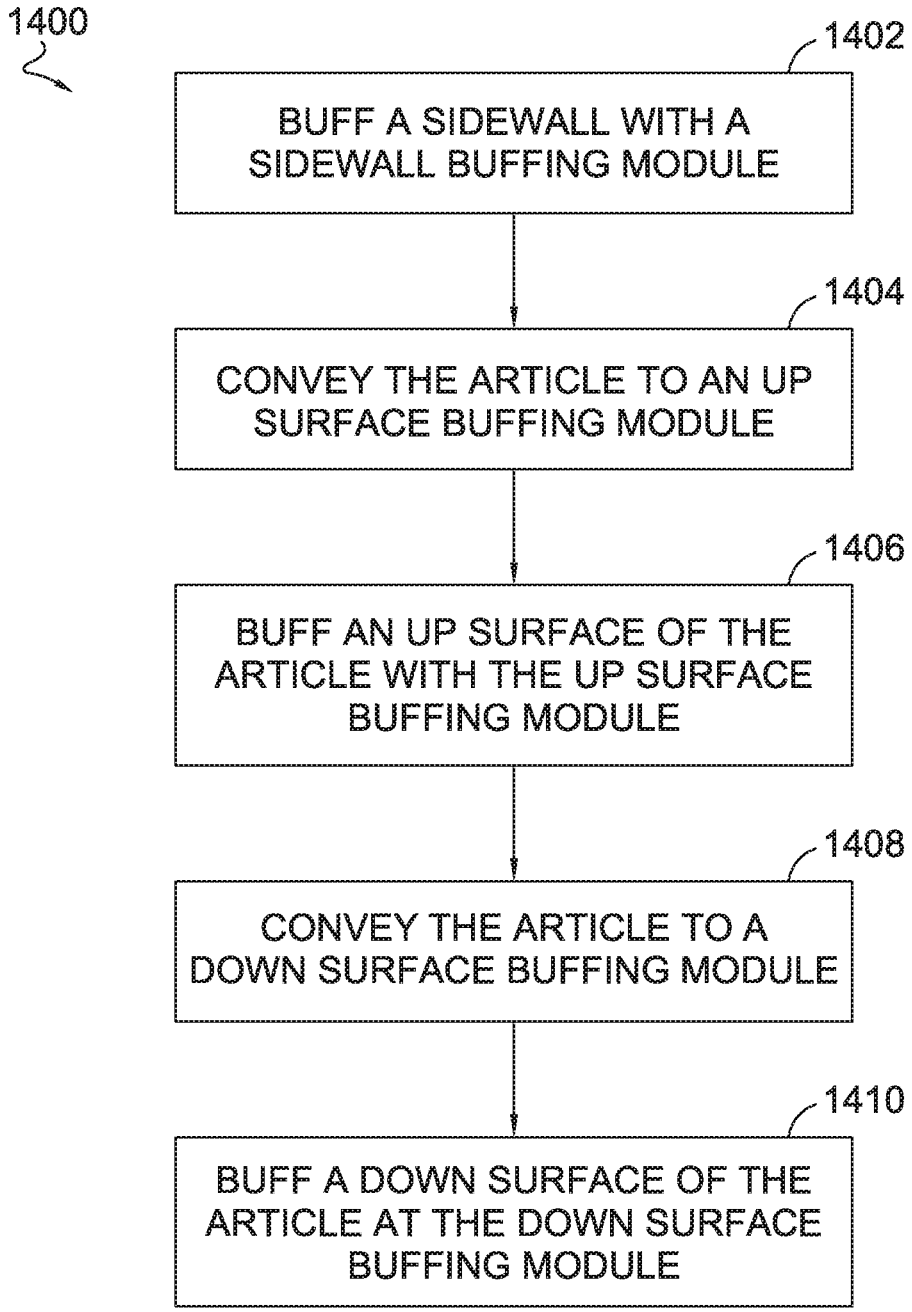
FIG. 14 depicts a flow diagram representing a method of buffing a component for an article of footwear, in accordance with aspects hereof.

FIG. 14 depicts a flow diagram 1400 representing a method of buffing a component for an article of footwear, in accordance with aspects hereof. The method begins with a block 1402 having a sidewall of the footwear component buffed with a sidewall buffing module. The method continues to a block 1404 where the footwear component is conveyed to an up surface buffing module. The conveyance may be achieved by a pronged support and compression mechanism (e.g., the conveyance mechanism 502 of FIG. 5) that is effective to collect and deposit the footwear component from/with a footwear component holder of the sidewall buffing module and the up surface buffing module. The method continues at a block 1406 where an up surface of the footwear component is buffed by the up surface buffing module. At a block 1408 that method continues with conveying the article to a down surface buffing module. A conveyance mechanism, such as the conveyance mechanism 502 of FIG. 5 may be leveraged to perform the conveyance. At a block 1410 the method includes buffing a down surface of the article at the down surface buffing module.

Figure 15:
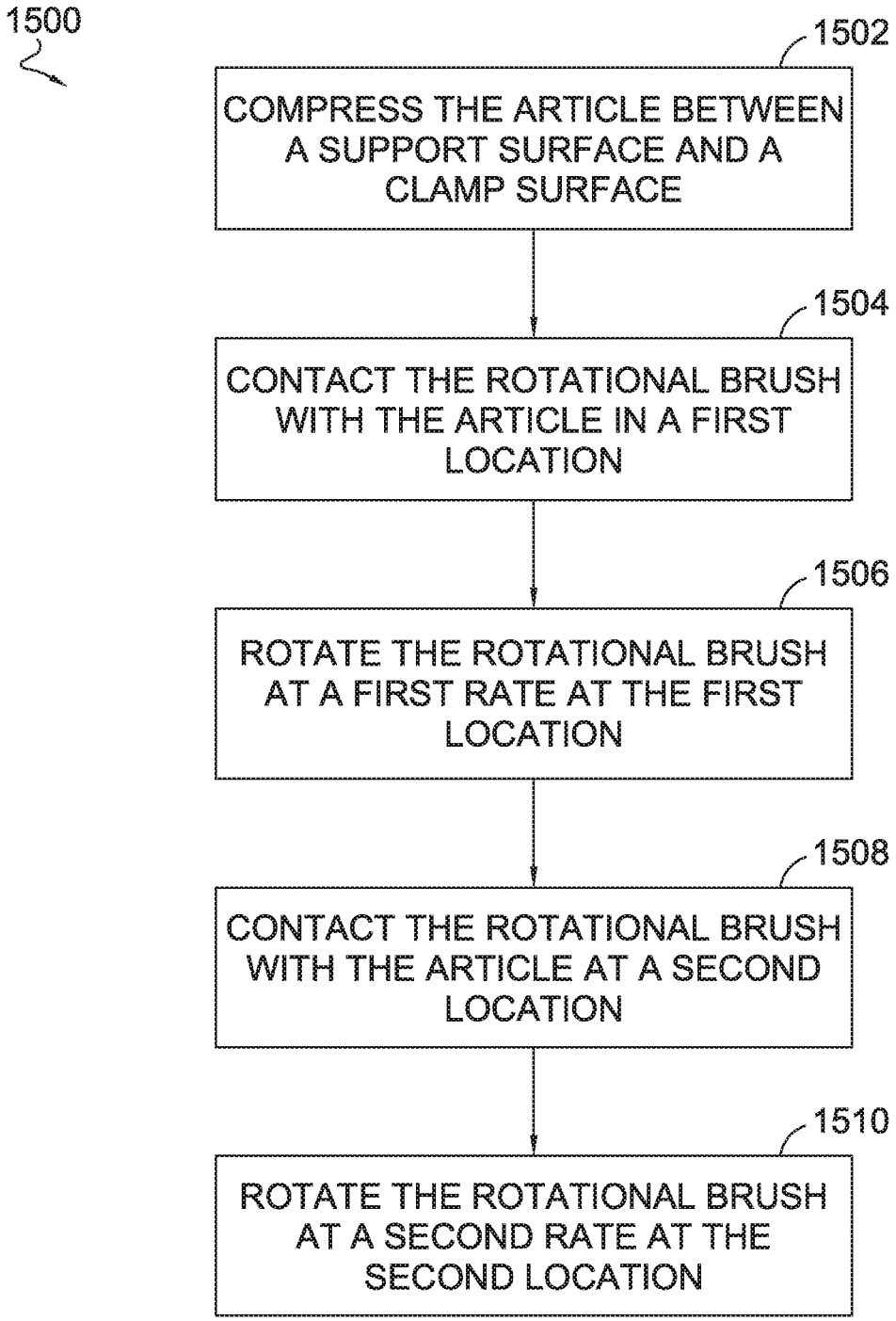
FIG. 15 depicts a flow diagram representing a method of buffing a sidewall surface of a component for an article of footwear, in accordance with aspects hereof.

FIG. 15 depicts a flow diagram 1500 representing a method of buffing a sidewall surface of a component for an article of footwear, in accordance with aspects hereof. At a block 1502 the method includes compressing the footwear component (e.g., article) between a support surface and a clamp surface (e.g., compression between first clamp 704 and the first footwear component holder 116 in FIG. 7). The method continues with a block 1504 with a rotational brush contacting the footwear component in a first location. For example, the first brush 130 may contact the sole 204 between (or at) any of the two references (e.g., A 302, B 304, C 306, D 308, E 310, F 312, G 315, or H 316 of FIG. 3) while the first brush 130 is rotating at a first rate, as depicted in a block 1506. The method continues at a block 1508 with the rotational brush contacting the article in a second location. The rotational brush may have maintained contact with the footwear component from the first location to the second location to provide a continuous buffing of a surface, such as a sidewall surface or other surface, to be placed in contact with the footwear component at the second location. At a block 1510 the rotational brush is rotated at a second rate while at the second location. The second rate may be faster or slower than the first rate and the difference in rotational rate may account for variation in speed at which the rotational brush is conveyed along a surface of the footwear component to achieve a consistent buffing result, in an example.

Figure 16:
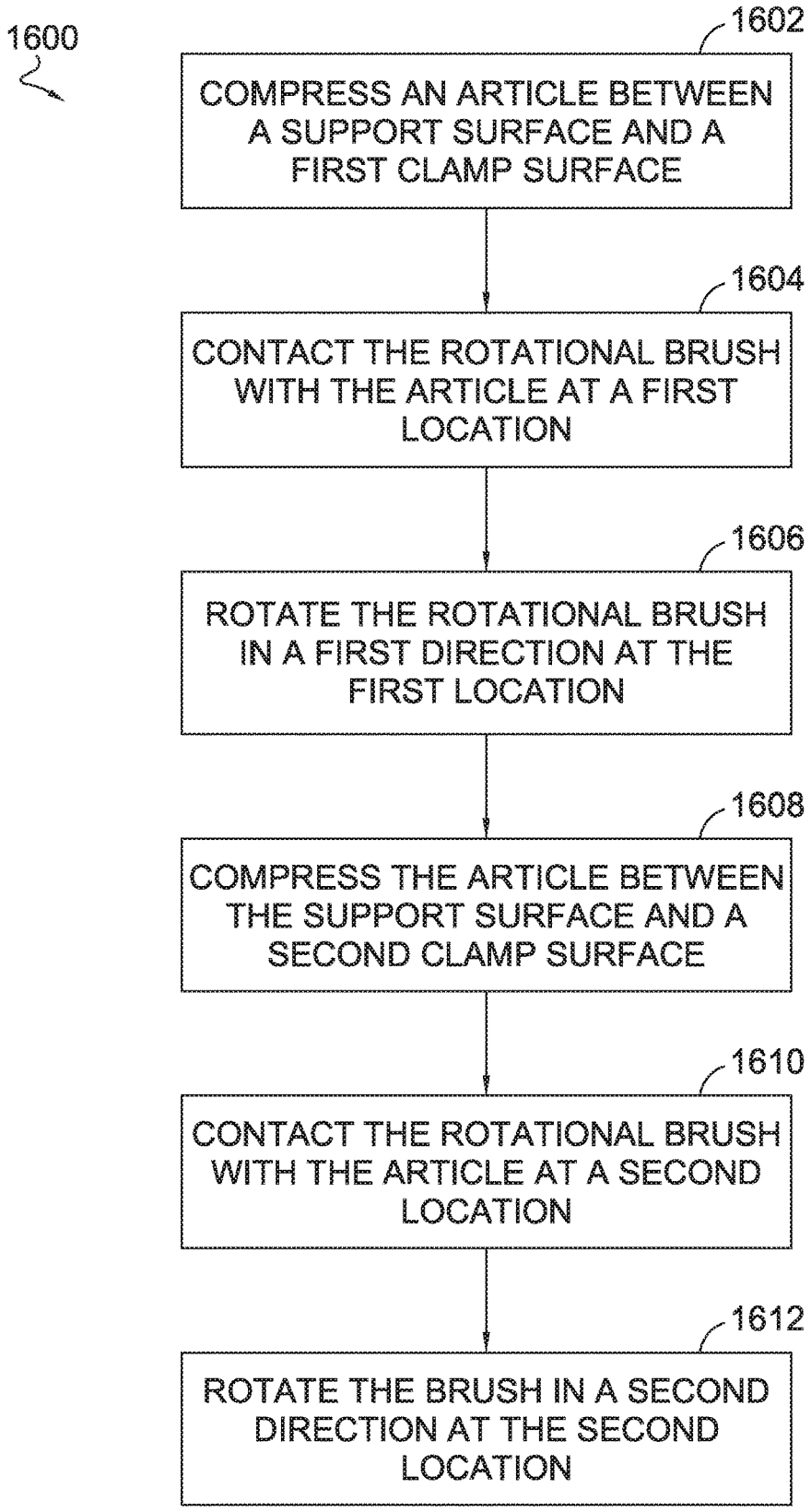
FIG. 16 depicts a flow diagram representing a method of buffing an up surface of a component for an article of footwear, in accordance with aspects hereof.

FIG. 16 depicts a flow diagram 1600 representing a method of buffing an up surface of a component for an article of footwear, in accordance with aspects hereof. The method begins with a block 1602 representing a compression of a footwear component between a support surface and a first clamp surface (e.g., first clamp 902 and the second footwear component holder 138 of FIG. 9). The method continues with a block 1604 in which a rotation brush (e.g., the second brush 140 of FIG. 9) contacts the footwear component at a first location (e.g., a toe end of the sole 204 of FIG. 9). A block 1606 provides for the rotation of the rotational brush in a first direction at the first location. A block 1608 provides for the compression of the article between the support surface and a second clamp surface. For example, as the second brush 140 of FIG. 9 is conveyed along the ground-facing surface 208 buffing said surface, the second brush 140 approach a portion of the ground-facing surface 208 that is obscured by the first clamp. To buff the surface contacted by the first clamp, a second clamp (e.g., the second clamp 904 of FIG. 10) clamps a previously buffed portion of the surface while the first clamp unclamps to expose the surface to be buffed by the second brush 140, in this example. At a block 1610 the rotational brush contacts the footwear component at a second location that is different from the first location. At a block 1612 the brush rotates in a second direction at the second location. The alternative rotational direction, in an example, allows for the buffing action of the rotating brush to aid in securing (e.g., pushing the footwear component into the support surface)

the footwear component to the support surface rather than the rotational direction of the rotational brush inhibiting (e.g., lifting the footwear component from the support surface) the securement of the footwear component to the support surface.

Figure 17:
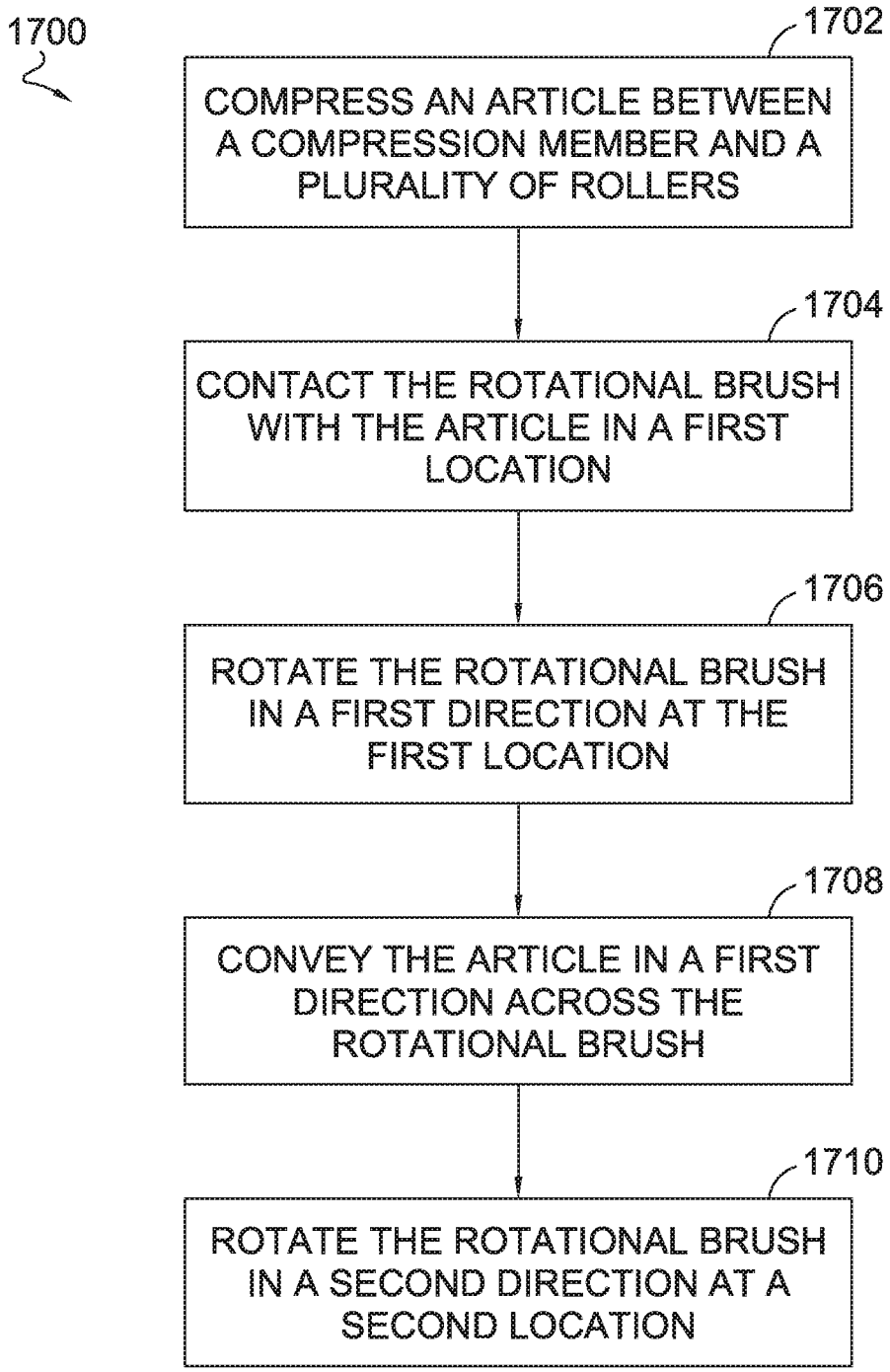
FIG. 17 depicts a flow diagram representing a method of buffing a down surface of a component for an article of footwear, in accordance with aspects hereof.

FIG. 17 depicts a flow diagram 1700 representing a method of buffing a down surface of a component for an article of footwear, in accordance with aspects hereof. The method includes a block 1702 depicting a compression of an article between a compression member and a plurality of rollers, such as the compression plate 158 and the plurality of rollers 148, 150 of FIG. 12. The method continues with a block 1704 where a rotational brush, such as the third brush 152 contacts the footwear component in a first location. A block 1706 provides for a rotation of the rotational brush in a first direction at the first location on the footwear component surface. A block 1708 provides for a conveyance of the footwear component in a first direction across the rotational brush, such as in a toe-to-heel direction of the sole 204 of FIG. 9. A block 1710 provides for rotation of the rotational brush in a second direction at a second location, such as proximate the heel end (e.g., within 1-15 cm of the heel end).

Figure 18:
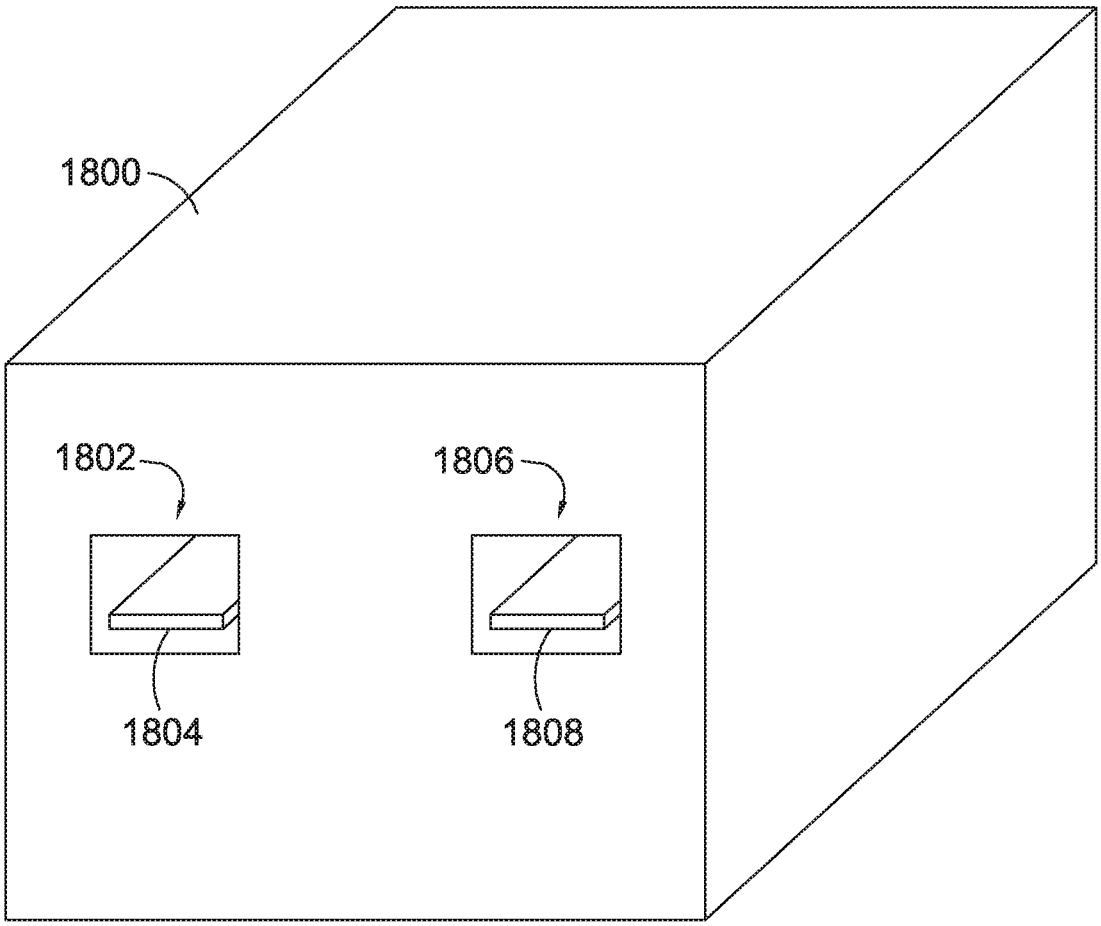
FIG. 18 depicts a dual line application of the system from FIG. 1, in accordance with aspects hereof.

Lastly, FIG. 18 depicts a dual line configuration 1800 of the system 100 from FIG. 1, in accordance with aspects hereof. While the description has focused on a single line for illustrations purposes, it is contemplated that a plurality of lines may operate in parallel. For example a first line 1804 and a second line 1808 may operate in parallel in a common system. Each of the first line 1804 and the second line 1808 include all of the modules and concepts discussed herein with connection to the system 100 of FIG. 1. In an exemplary aspect, the right side of a pair of footwear is buffed in a first of the two lines and the left side of the pair of footwear is buffed in the second of the two lines of the dual line configuration 1800. An operator may provide the footwear component at an entrance 1802 for the first line 1804 and the operator may provide the footwear component at an entrance 1806 for the second line 1808.

From the foregoing, it will be seen that this invention is one well-adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

As used herein and in connection with the claims listed hereinafter, the terminology "any of clauses" or similar variations of said terminology is intended to be interpreted such that features of claims/clauses may be combined in any combination. For example, an exemplary clause 4 may indicate the method/apparatus of any of clauses 1 through 3, which is intended to be interpreted such that features of clause 1 and clause 4 may be combined, elements of clause 2 and clause 4 may be combined, elements of clause 3 and 4 may be combined, elements of clauses 1, 2, and 4 may be combined, elements of clauses 2, 3, and 4 may be combined, elements of clauses 1, 2, 3, and 4 may be combined, and/or other variations. Further, the terminology "any of clauses" or similar variations of said terminology is intended to include "any one of clauses" or other variations of such terminology, as indicated by some of the examples provided above.

The following clauses are aspects contemplated herein.

1. An article of footwear up surface buffing system, the system comprising: a rotational brush with a plurality of bristles extending outwardly from a rotational axis of the rotational brush; a footwear component holder comprising a support surface, a first clamp surface, and a second clamp surface; and a brush rotational drive coupled with the rotational brush to rotate the rotational brush in first direction and in a second direction based on location of the rotational brush relative to the footwear component holder.

2. The system of clause 1, wherein the first clamp is in a clamp position and the second clamp is in an unclamped position when the rotational brush rotates in the first direction and the second clamp is in a clamp position and the first clamp is in an unclamped position when the rotational brush rotates in the second direction.

3. The system of clause 2, wherein the support surface has a toe end and a heel end and the first clamp is closer to the toe end than the heel end and the second clamp is closer to the heel end than the toe end.

4. The system of any of the clauses 1-3, wherein the rotational brush applies 2-3 kilograms per cubic centimeter of pressure to an article of footwear component.

5. The system of any of the clauses 1-4, wherein the support surface is comprised of a first surface separated and spaced from a second surface.

6. The system of clause 5 further comprising a conveyance mechanism having a support element, the support element sized to fit between the first surface and the second surface of the support surface.

7. The system of any of the clauses 1-6, wherein the rotational brush has a diameter between 100-180 mm.

8. The system of any of the clauses 1-6, wherein the rotational brush has a diameter between 120-160 mm.

9. The system of any of the clauses 1-6, wherein the rotational brush has a diameter between 140-150 mm.

10. The system of any of the clauses 1-9, wherein the plurality of bristles forming the rotational brush are comprised of a nylon composition.

11. The system of any of the clauses 1-10, wherein the brush rotational drive is effective to rotate the rotational brush at a rotational speed of 500-3000 RPM, 1000-2400 RPM, or 1400-2200 RPM.

12. The system of any of the clauses 1-11 further comprising a brush movement mechanism effective to move the rotational brush from the a heel end to a toe end of the support surface.

13. The system of clause 12, wherein the brush movement mechanism positions the rotational brush between a first distance and second distance offset from the support surface.

14. The system of clause 13, wherein the brush movement mechanism moves in a first linear direction with the rotational brush rotating in the first direction and the brush movement mechanism moves in a second linear direction with the rotational brush rotating in the second direction.

15. A method of buffing an article of footwear component with a footwear up surface buffing system, the method comprising: compressing the article of footwear component between a support surface and a first clamp surface of a footwear component holder; contacting the rotational brush with the article of footwear component at a first location;

rotating the rotational brush in a first direction at the first location; compressing the article of footwear component between the support surface and a second clamp surface of the footwear component holder; contacting the rotational brush with the article of footwear component at a second location, wherein the first location is different from the second location; and rotating the brush in a second direction at the second location.

16. The method of clause 15, wherein the first location is a heel end of the article of footwear component.

17. The method of clause 16, wherein the second location is a toe end of the article of footwear component.

18. The method of clause 17, wherein the second clamp is in an unclamped position when the rotational brush is at the first location and the second clamp is in an unclamped position when the rotational brush is at the second location.

19. The method of any of clause 15-18, wherein the rotational brush has a diameter defined by bristles extending from the rotational brush and wherein the rotational brush contacts the article of footwear component at the first location such that a portion of the article of footwear extends at least 5 mm into the rotational brush diameter.

20. The method of any of clauses 15-19, wherein the rotational brush rotates at a rotational rate within a range of about 1400-2200 RPM at the first location.

21. The method of any of clauses 15-20, wherein the rotational brush applies 2-3 kilograms per cubic centimeter of pressure to the article of footwear component.

The invention claimed is:

1. An article of footwear up surface buffing system, the system comprising:

a rotational brush with a plurality of bristles extending outwardly from a rotational axis of the rotational brush;

a footwear component holder comprising a support surface, a first clamp, and a second clamp; and a brush rotational drive coupled with the rotational brush to rotate the rotational brush in first direction and in a second direction based on location of the rotational brush relative to the footwear component holder;

wherein the first clamp and the second clamp are each configured to separately move from a clamped position to an unclamped position relative to the footwear component holder;

wherein the first clamp is in the clamped position and the second clamp is in the unclamped position when the rotational brush is rotated in the first direction; and wherein the second clamp is in the clamped position and the first clamp is in the unclamped position when the rotational brush is rotated in the second direction.

2. The system of claim 1, wherein the first clamp is in a clamp position and the second clamp is in an unclamped position when the rotational brush rotates in the first direction and the second clamp is in a clamp position and the first clamp is in an unclamped position when the rotational brush rotates in the second direction.

3. The system of claim 2, wherein the support surface has a toe end and a heel end and the first clamp is closer to the toe end than the heel end and the second clamp is closer to the heel end than the toe end.

4. The system of claim 1, wherein the rotational brush applies 2-3 kilograms per cubic centimeter of pressure to an article of footwear component.

5. The system of claim 1, wherein the support surface is comprised of a first surface separated and spaced from a second surface.

6. The system of claim 5 further comprising a conveyance mechanism having a support element, the support element sized to fit between the first surface and the second surface of the support surface.

7. The system of claim 1, wherein the rotational brush has a diameter between 100-180 mm.

8. The system of claim 1, wherein the rotational brush has a diameter between 120-160 mm.

9. The system of claim 1, wherein the rotational brush has a diameter between 140-150 mm.

10. The system of claim 1, wherein the plurality of bristles forming the rotational brush are comprised of a nylon composition.

11. The system of claim 1, wherein the brush rotational drive is effective to rotate the rotational brush at a rotational speed of 500-3000 RPM, 1000-2400 RPM, or 1400-2200 RPM.

12. The system of claim 1 further comprising a brush movement mechanism effective to move the rotational brush from a heel end to a toe end of the support surface.

13. The system of claim 12, wherein the brush movement mechanism positions the rotational brush between a first distance and second distance offset from the support surface.

14. The system of claim 13, wherein the brush movement mechanism moves in a first linear direction with the rotational brush rotating in the first direction and the brush movement mechanism moves in a second linear direction with the rotational brush rotating in the second direction.

15. A method of buffing an article of footwear component with a footwear up surface buffing system, the method comprising:

compressing the article of footwear component between a support surface and a first clamp of a footwear component holder;

contacting a rotational brush with the article of footwear component at a first location;

rotating the rotational brush in a first direction at the first location;

compressing the article of footwear component between the support surface and a second clamp of the footwear component holder;

contacting the rotational brush with the article of footwear component at a second location, wherein the first location is different from the second location; and rotating the rotational brush in a second direction at the second location.

16. The method of claim 15, wherein the first location is a heel end of the article of footwear component.

17. The method of claim 16, wherein the second location is a toe end of the article of footwear component.

18. The method of claim 17, wherein the second clamp is in an unclamped position when the rotational brush is at the first location and the second clamp is in an unclamped position when the rotational brush is at the second location.

19. The method of claim 15, wherein the rotational brush has a diameter defined by bristles extending from the rotational brush and wherein the rotational brush contacts the article of footwear component at the first location such that a portion of the article of footwear component extends at least 5 mm into the rotational brush diameter.

20. The method of claim 15, wherein the rotational brush rotates at a rotational rate within a range of 1400-2200 RPM at the first location.

21. The method of claim 15, wherein the rotational brush applies 2-3 kilograms per cubic centimeter of pressure to the article of footwear component.

* * * * *